US007486015B2

(12) United States Patent
Oh

(10) Patent No.: US 7,486,015 B2
(45) Date of Patent: Feb. 3, 2009

(54) FIELD EMISSION DISPLAY (FED) AND METHOD OF MANUFACTURE THEREOF

(75) Inventor: Tae-Sik Oh, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 523 days.

(21) Appl. No.: 11/131,282

(22) Filed: May 18, 2005

(65) Prior Publication Data

US 2005/0264170 A1 Dec. 1, 2005

(30) Foreign Application Priority Data

May 29, 2004 (KR) ..... 10-2004-0038720

(51) Int. Cl.
*H01J 1/62* (2006.01)

(52) U.S. Cl. ..... 313/497; 313/495

(58) Field of Classification Search ..... None
See application file for complete search history.

(56) References Cited

U.S. PATENT DOCUMENTS

| | | | | |
|---|---|---|---|---|
| 5,552,659 | A | 9/1996 | Macaulay et al. | |
| 6,437,503 | B1 * | 8/2002 | Konuma | 313/495 |
| 2004/0004429 | A1 * | 1/2004 | Oh et al. | 313/495 |

FOREIGN PATENT DOCUMENTS

| | | | |
|---|---|---|---|
| EP | 1313122 | A1 * | 5/2003 |
| JP | 2000-348602 | | 12/2000 |
| JP | 2003-016907 | | 1/2003 |
| JP | 2003-016910 | | 1/2003 |
| KR | 1020040017420 | * | 2/2004 |

OTHER PUBLICATIONS

U.S. Appl. No. 11/131,413, filed May 2005, Tae-Sik Oh.

* cited by examiner

*Primary Examiner*—Toan Ton
*Assistant Examiner*—Britt Hanley
(74) *Attorney, Agent, or Firm*—Robert E. Bushnell, Esq.

(57) ABSTRACT

A Field Emission Display (FED) includes: a first substrate; a first insulating layer arranged on the first substrate; a cathode arranged on the first substrate to cover the first insulating layer, the cathode having a first concave opening arranged between portions thereof covering the first insulating layer: a second insulating layer arranged on the first substrate and the cathode, the second insulating layer having a second opening connected to the first opening to expose a portion of the cathode; a gate electrode arranged on the second insulating layer, the gate electrode having a third opening connected to the second opening; a plurality of emitters arranged on the cathode in the first opening and along both edges of the first opening and spaced apart from each other; and a second substrate facing the first substrate and spaced apart therefrom and having an anode and a fluorescent layer arranged on a surface thereof.

22 Claims, 19 Drawing Sheets

FIELD EMISSION DISPLAY (FED) AND METHOD OF MANUFACTURE THEREOF

CLAIM OF PRIORITY

This application makes reference to, incorporates the same herein, and claims all benefits accruing under 35 U.S.C. § 119 from an application for FIELD EMISSION DISPLAY AND METHOD OF MANUFACTURING THE SAME earlier filed in the Korean Intellectual Property Office on May 29, 2004 and there duly assigned Serial No. 10-2004-0038720.

CROSS-REFERENCE TO RELATED APPLICATIONS

Furthermore, the present application is related to a co-pending U.S. applications, Ser. No. 11/131,413, entitled FIELD EMISSION DISPLAY AND METHOD OF MANUFACTURING THE SAME, based upon Korean Patent Application Serial No. 10-2004-0036672 filed in the Korean Intellectual Property Office on May 22, 2004, and filed in the U.S. Patent & Trademark Office concurrently with the present application.

BACKGROUND OF THE INVENTION

1. Field of the Invention

The present invention relates to a Field Emission Display (FED) having an electron emitting structure which improves electron beam focusing and prevents a decrease in current density.

2. Description of the Related Art

An image display is typically used as a monitor for a Personal Computer (PC) or a television receiver. The image display can be a Cathode Ray Tube (CRT), a flat panel display such as a Liquid Crystal Display (LCD), a Plasma Display Panel (PDP), and a Field Emission Display (FED).

In the FED, electrons are emitted from an emitter regularly arranged on a cathode by supplying a strong electric field to the emitter from a gate electrode and collide with a fluorescent material coated on a surface of an anode, thereby emitting light. Since the FED forms an image by using a cool cathode electron as an electron emitting source, the image quality is highly affected by the material and structure of the emitter.

A Spindt-type metal tip (or micro tip), which is mainly composed of molybdenum, has been used as the emitter in early FEDs.

In the FED having the metal tip emitter, an ultrafine hole must be formed in order to place the emitter and molybdenum has to be deposited to form a uniform metal micro tip in the entire area of a picture plane. Thus, the manufacturing process is complicated and expensive equipment has to be used, thereby increasing the production costs of the FED. Accordingly, an FED having the metal tip emitter cannot be used for large screens.

Thus, a technique for forming a flat emitter is being studied to obtain good electron emission even with a low voltage drive and to simplify the manufacturing process.

Recently, carbon-based materials, for example, graphite, diamond, Diamond Like Carbon (DLC), $C_{60}$ (Fullerene), and Carbon Nano-Tubes (CNTs) have been used for the flat emitter. Of the above materials, CNT can actively cause electron emission even at a relatively low drive voltage.

A FED having a triode structure includes a cathode, an anode, and a gate electrode. The cathode and the gate electrode are formed on a rear substrate and the anode is formed on a lower surface of a front substrate. Fluorescent layers, composed of R, G, and B phosphors, and a black matrix for improving contrast are formed on the lower surface of the anode. The rear substrate and the front substrate are spaced from each other by a spacer arranged therebetween. In such an FED, the cathode is first formed on the rear substrate, an insulating layer and the gate electrode which have fine openings are stacked thereon, and then emitters are arranged on the cathode located in the openings.

However, the FED having the triode structure as described above has low color purity during driving and has difficulty in obtaining a clear image. These problems occur because most electrons are emitted from an edge portion of the emitter and an electron beam proceeding toward the fluorescent layer diverges due to the voltage (a positive voltage of several volts through tens of volts) supplied to the gate electrode, thereby allowing a phosphor of adjacent other pixel as well as a phosphor of the intended pixel to emit light.

To resolve the above problems, an effort has been made to restrict the electron beam from the emitter from diverging by reducing the area of the emitter corresponding to one pixel to dispose a number of emitters. However, it is difficult to form a number of emitters in a pixel of a predetermined size and the entire area of the emitters for allowing a phosphor of the concerned pixel to emit light decreases. Also, the effect of focusing the electron beam is not sufficient.

In order to prevent the electron beam from diverging, a FED in which a separate electrode for focusing the electron beam is arranged around the gate electrode has been proposed.

An FED in which an electron beam is focused by disposing a ring shaped focusing electrode around the gate electrode or an FED in which an electron beam is focused by using a dual gate composed of a lower gate electrode and an upper gate electrode can be used. However, these FEDs have complicated structures. Also, since the above structures have been mainly applied to a FED having a metal tip emitter formed on the cathode, when the structures are applied to a FED having flat shape emitter, a satisfactory effect has not yet been obtained.

U.S. Pat. No. 5,552,659 relates to an electron emitting structure capable of reducing the divergence of the electron beam by defining thicknesses of a non-insulating layer and a dielectric layer which are formed on a substrate on which an emitter is arranged. However, a number of holes with respect to one pixel are formed and a fine structure composed of a number of electron emitting sources is formed in the respective hole. Thus, the structure is very complicated so that manufacturing is difficult and the structure is also spatially limited. Accordingly, there is a limitation in maximizing the number and the area of the emitter with respect to one pixel, thereby shortening the lifetime.

Also, Japanese Laid-Open Patent Publication Nos. 2000-348602, 2003-16907, and 2003-16910 relate an electron emitting structure having a flat emitter. The electron emitting structure can focus an electron beam by altering the shape of a cathode. However, the density of an electric current emitted from the emitter generally decreases, and thus, a driving voltage increases.

SUMMARY OF THE INVENTION

The present invention provides a Field Emission Display (FED) having an electron emitting structure which improves electron beam focusing and prevents a decrease in current density, and a method of manufacture thereof.

According to one aspect of the present invention, a Field Emission Display (FED) is provided comprising: a first substrate; a first insulating layer arranged on the first substrate; a cathode arranged on the first substrate to cover the first insulating layer, the cathode having a first concave opening arranged between portions thereof covering the first insulating layer: a second insulating layer arranged on the first substrate and the cathode, the second insulating layer having a second opening connected to the first opening to expose a portion of the cathode; a gate electrode arranged on the second insulating layer, the gate electrode having a third opening connected to the second opening; a plurality of emitters arranged on the cathode in the first opening and along both edges of the first opening and spaced apart from each other; and a second substrate facing the first substrate and spaced apart therefrom and having an anode and a fluorescent layer arranged on a surface thereof.

The cathode preferably comprises a cavity arranged between the plurality of emitters.

The first, second, and third openings and the cavity are preferably square.

The width of the second opening is preferably greater than that of the first opening and the width of the cavity is preferably less than that of the first opening.

The distance between the plurality of emitters is preferably less than the width of the first opening and is preferably greater than the width of the cavity.

The width of the third opening is preferably equal to that of the second opening.

The width of the third opening is alternatively preferably greater than that of the second opening.

The first insulating layer is preferably arranged on both outer sides of the first opening and extends in a direction of a length of the cathode along both edges of the cathode.

The first insulating layer is alternatively preferably arranged on both outer sides of the first opening and a portion of the first insulating layer is preferably arranged on both edges of the cathode.

The first insulating layer preferably surrounds the first opening.

At least one of the plurality of emitters preferably contacts a side surface of the cathode arranged on both sides of the first opening.

A height of at least one of the plurality of emitters is preferably less than that of the first insulating layer.

At least one of the plurality of emitters preferably comprises a carbon based material.

At least one of the plurality of emitters preferably comprises Carbon Nano-Tubes (CNTs).

A plurality of first openings, second openings, and third openings are preferably arranged with respect to one pixel and at least one of the plurality of emitters is preferably arranged in each first opening.

According to another aspect of the present invention, a Field Emission Display (FED) is provided comprising: a first substrate; a first insulating layer arranged on the first substrate; a cathode arranged on the first substrate to cover the first insulating layer, the cathode having a first concave circular opening arranged inside a portion thereof covering the first insulating layer: a second insulating layer arranged on the first substrate and the cathode, the second insulating layer having a second circular opening connected to the first circular opening to expose a portion of the cathode; a gate electrode arranged on the second insulating layer, the gate electrode having a third circular opening connected to the second circular opening; a plurality of ring shaped emitters arranged on the cathode arranged in the first opening; and a second substrate facing the first substrate and spaced apart therefrom, the second substrate having an anode and a fluorescent layer arranged on a surface thereof.

A circular cavity is preferably arranged inside the emitter in the cathode.

The inner diameter of the second opening is preferably greater than that of the first opening and the inner diameter of the cavity is preferably less than that of the first opening.

The inner diameter of at least one of the emitters is preferably less than that of the first opening and is preferably greater than that of the cavity.

The inner diameter of the third opening is preferably equal to that of the second opening.

The inner diameter of the third opening is alternatively preferably greater than that of the second opening.

The emitter is preferably in contact with a side surface of the cathode surrounding the first opening.

A height of at least one of the emitters is preferably less than the that of the first insulating layer.

At least one of the emitters preferably comprises a carbon based material.

At least one of the emitters preferably comprises Carbon Nano-Tubes (CNTs).

A plurality of first openings, second openings, and third openings are preferably arranged with respect to one pixel and at least one of the emitters is preferably arranged inside each first opening.

According to yet another aspect of the present invention, a method of manufacturing a FED is provided, the method comprising: forming a first insulating layer on a substrate; forming a cathode covering the first insulating layer, the cathode having a first concave opening formed between portions thereof covering the first insulating layer on the substrate; forming a second insulating layer covering the cathode on the substrate; forming a metallic layer, the metallic layer having an aperture arranged in a position corresponding to the first opening on the second insulating layer; etching the second insulating layer through the aperture to form a second opening connected to the first opening and exposing a portion of the cathode; patterning the metallic layer to form a gate electrode having a third opening connected to the second opening; and forming a plurality of emitters on the cathode in the first opening.

Forming the first insulating layer preferably comprises coating an insulating paste on the substrate and then patterning it.

The insulating paste is preferably coated by screen printing.

Forming the cathode preferably comprises depositing an electrically conductive material on the substrate to cover the first insulating layer and then patterning it in stripes.

Forming the cathode preferably comprises forming a cavity arranged in the first opening and smaller than the first opening in the cathode.

Forming the second insulating layer preferably comprises coating an insulating paste on the substrate by screen printing and sintering it.

Forming the metallic layer preferably comprises depositing an electrically conductive metallic material on the second insulating layer by sputtering and forming the aperture by partially etching the metallic layer.

Etching the second insulating layer preferably comprises using the metallic layer as an etching mask.

Forming the gate electrode preferably comprises patterning the metallic layer in stripes.

Forming the plurality of emitters preferably comprises: coating a Carbon Nano-Tube (CNT) photosensitive paste inside the first opening and the second opening; irradiating light behind the substrate to selectively expose only a portion of the CNT paste arranged on the cathode in the first opening; and removing the remainder of the CNT paste not exposed to light to form the plurality of emitters of the remaining CNTs.

The substrate preferably comprises a transparent glass and the cathode comprises Indium Tin Oxide (ITO).

Forming the plurality of emitters alternatively preferably comprises: coating a photoresist inside the first opening and the second opening and pattering it to remain only on the surface of the cathode in the first opening; coating a Carbon Nano-Tube (CNT) paste inside the first opening and the second opening; heating the substrate to form the plurality of emitters by thermochemical reaction between the photoresist and the CNT paste; and removing a portion of the CNT paste not undergoing the thermochemical reaction.

Forming the plurality of emitters alternatively preferably comprises: forming a catalytic metal layer on the surface of the cathode arranged in the first opening; and vertically growing Carbon Nano-Tubes (CNTs) from the surface of the catalytic metal layer by supplying a carbon-containing gas to the catalytic metal layer.

A height of the plurality of emitters is preferably smaller than that of the first insulating layer.

The first opening, second opening, and third opening are preferably square.

The plurality of emitters are preferably formed along both edges of the first opening and have a rod shape.

The first opening, second opening, and third opening are alternatively preferably circular.

The plurality of emitters are alternatively preferably ring shaped.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings, in which like reference symbols indicate the same or similar components, wherein:

FIG. 1A is a partial cross-sectional view of the FED and FIG. 1B is a partial plan view of the FED;

DETAILED DESCRIPTION OF THE INVENTION

Figure 1A:
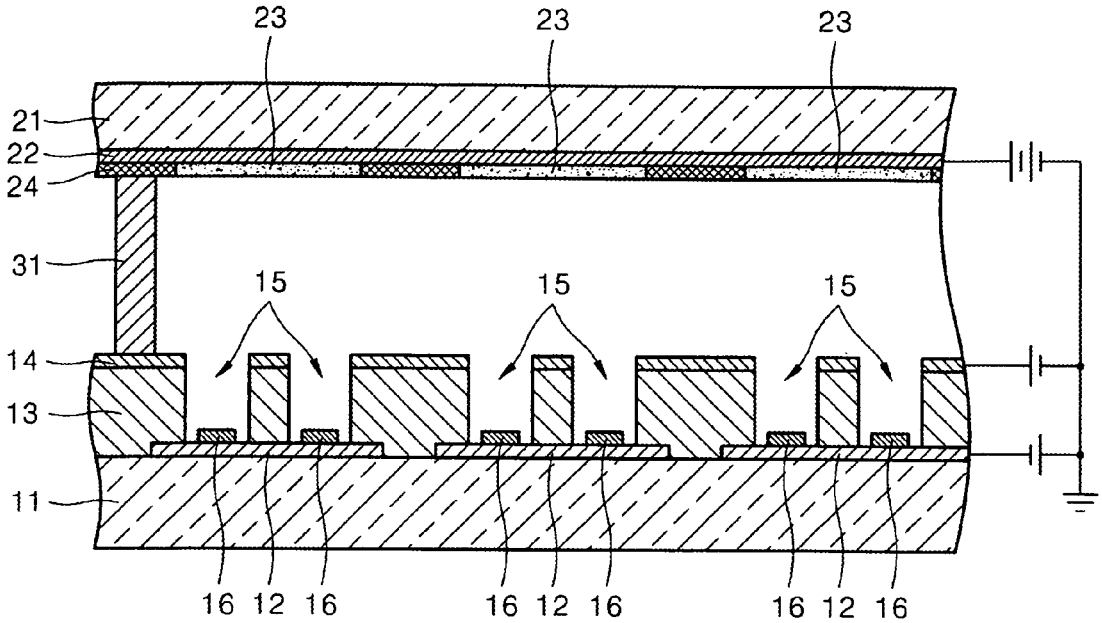
FIG. 1A (PRIOR ART)
FIGS. 1A and 1B are views of a Field Emission Display (FED)
Figure 1B:
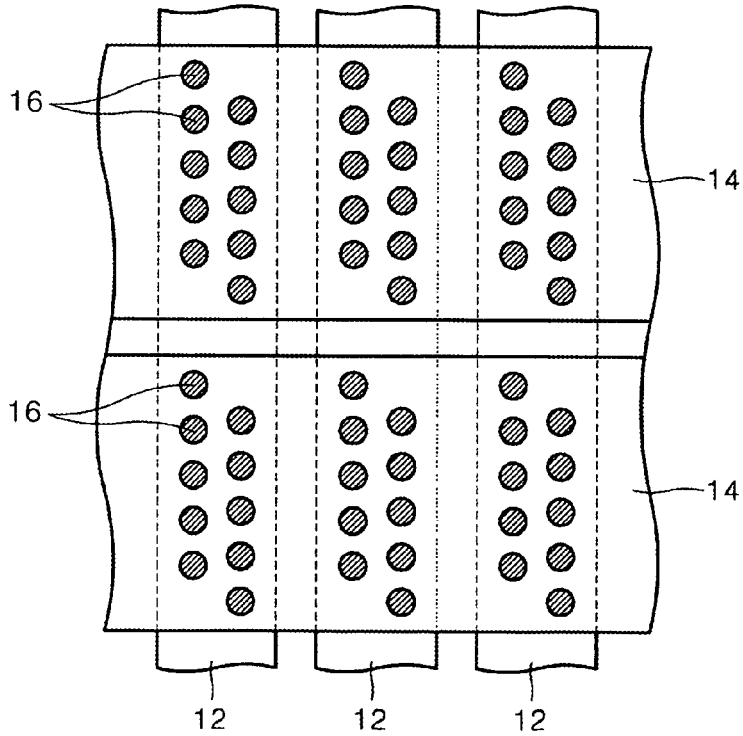
FIG. 1B (PRIOR ART)

FIGS. 1A and 1B are views of an FED, FIG. 1A is a partial cross-sectional view of the FED and FIG. 1B is a partial plan view of the FED.

Referring to FIGS. 1A and 1B, the FED has a triode structure including a cathode 12, an anode 22, and a gate electrode 14. The cathode 12 and the gate electrode 14 are formed on a rear substrate 11 and the anode 22 is formed on a lower surface of a front substrate 21. Fluorescent layers 23, composed of R, G, and B phosphors, and a black matrix 24 for improving contrast are formed on the lower surface of the anode 22. The rear substrate 11 and the front substrate 21 are spaced from each other by a spacer 31 arranged therebetween. In such an FED, the cathode 12 is first formed on the rear substrate 11, an insulating layer 13 and the gate electrode 14 which have fine openings 15 are stacked thereon, and then emitters 16 are arranged on the cathode 12 located in the openings 15.

However, the FED having the triode structure as described above has low color purity during driving and has difficulty in obtaining a clear image. These problems occur because most electrons are emitted from an edge portion of the emitter 16 and an electron beam proceeding toward the fluorescent layer 23 diverges due to the voltage (a positive voltage of several volts through tens of volts) supplied to the gate electrode 14, thereby allowing a phosphor of adjacent other pixel as well as a phosphor of the intended pixel to emit light.

To resolve the above problems, an effort has been made to restrict the electron beam from the emitter 16 from diverging by reducing the area of the emitter 16 corresponding to one pixel to dispose a number of emitters 16. However, it is difficult to form a number of emitters 16 in a pixel of a predetermined size and the entire area of the emitters 16 for allowing a phosphor of the concerned pixel to emit light decreases. Also, the effect of focusing the electron beam is not sufficient.

Figure 2A:
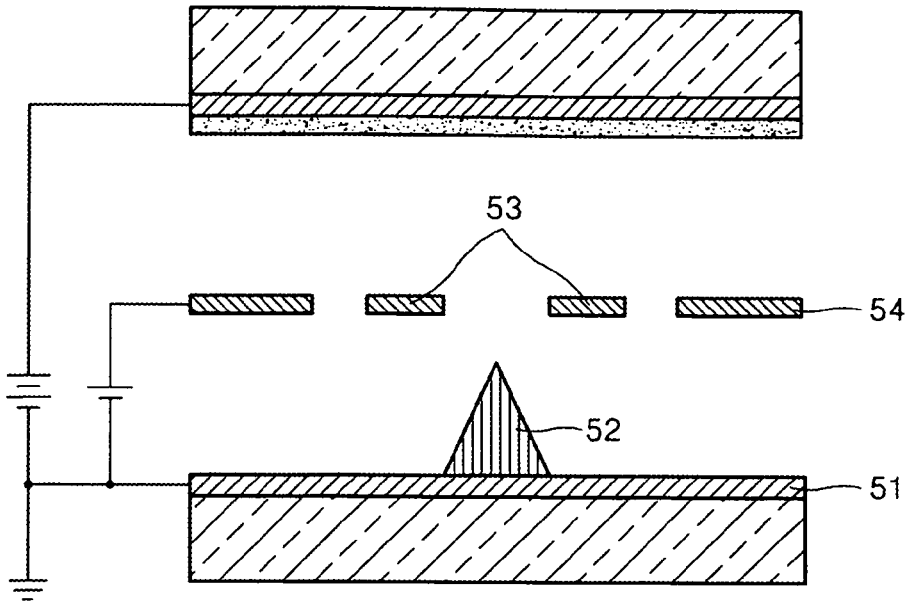
FIG. 2A (PRIOR ART)
FIGS. 2A and 2B are partial cross-sectional views of other FEDs.
Figure 2B:
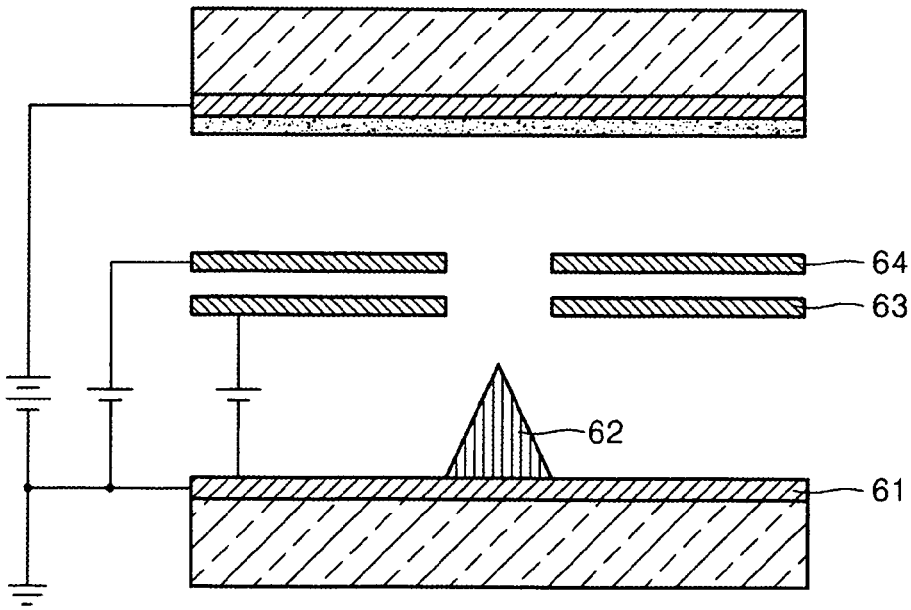
FIG. 2B (PRIOR ART)

In order to prevent the electron beam from diverging, a FED in which a separate electrode 54 or 64 for focusing the electron beam is arranged around the gate electrode 53 or 63, as shown in FIGS. 2A and 2B has been proposed.

FIG. 2A illustrates an FED in which an electron beam is focused by disposing a ring shaped focusing electrode 54 around the gate electrode 53. FIG. 2B illustrates an FED in which an electron beam is focused by using a dual gate composed of a lower gate electrode 63 and an upper gate electrode 64. However, these FEDs have complicated structures. Also, since the above structures have been mainly applied to a FED having a metal tip emitter 52 or 62 formed on the cathode 51 or 61, when the structures are applied to an FED having the flat shape emitter, a satisfactory effect has not yet been obtained.

The present invention will now be described more fully with reference to the accompanying drawings in which embodiments of the present invention are shown. In the drawings, like reference numbers refer to like elements throughout, and the sizes of elements may be exaggerated for clarity.

Figure 3:
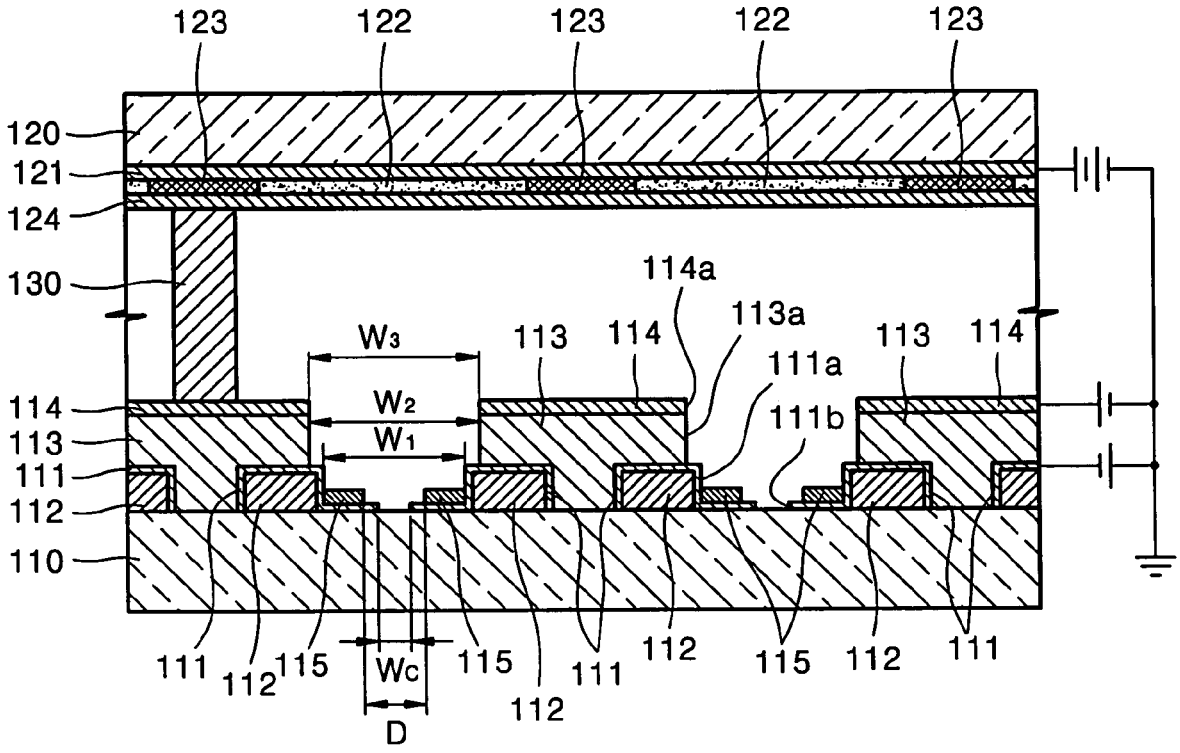
FIG. 3 is a partial cross-sectional view of a FED according to an embodiment of the present invention.
Figure 4:
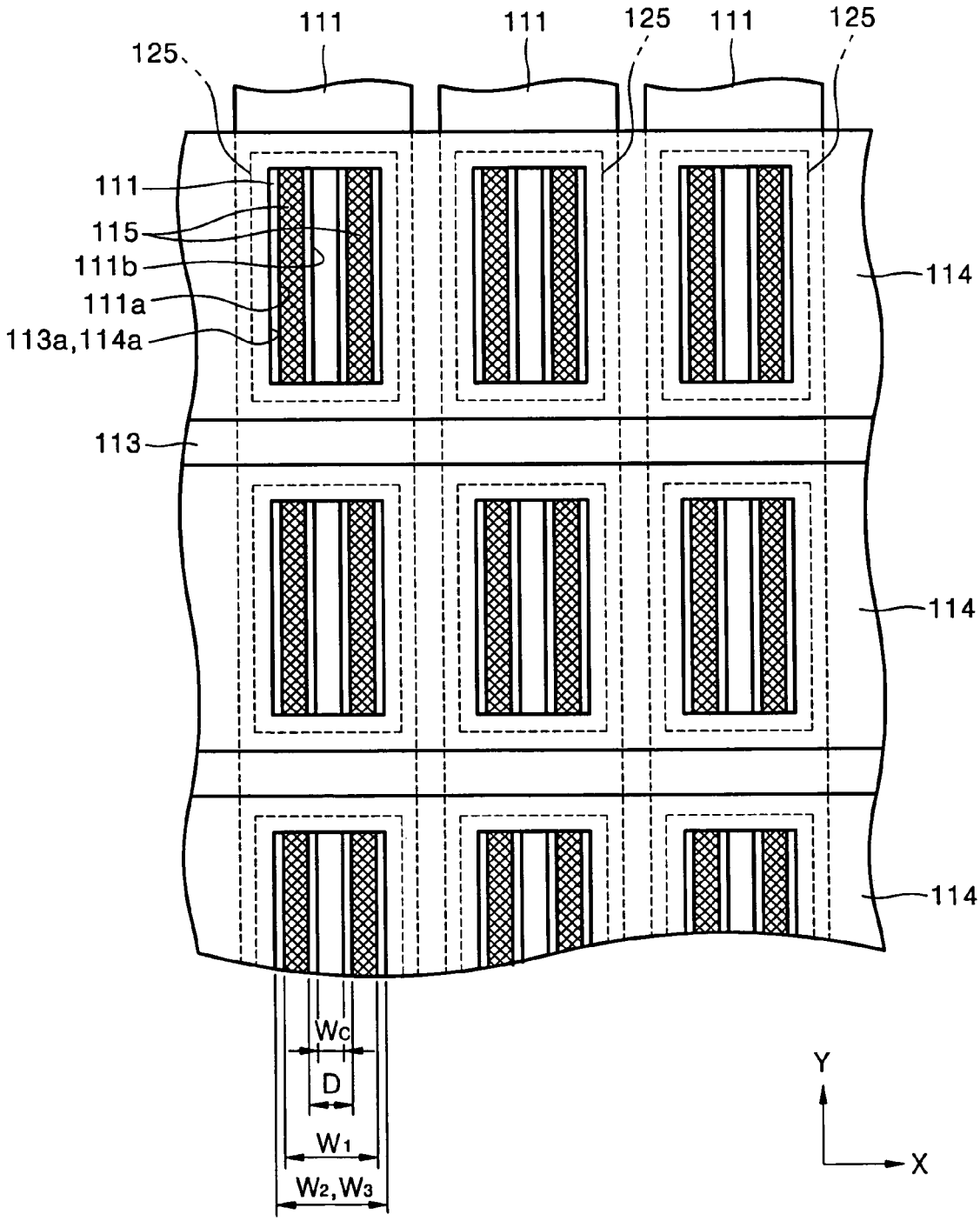
FIG. 4 is a partial plan view of an arrangement of the elements formed on a rear substrate of the FED of FIG. 3.

FIG. 3 is a partial cross-sectional view of the structure of a FED according to an embodiment of the present invention and FIG. 4 is a partial plan view of the arrangement of elements formed on a rear substrate of the FED of FIG. 3.

Referring to FIGS. 3 and 4, the FED according to an embodiment of the present invention includes two substrates facing each other and separated by a predetermined distance, i.e., a first substrate 110 which is typically called a rear substrate and a second substrate 120 which is typically called a front substrate. The rear substrate 110 and the front substrate 120 are separated by a uniform distance with a spacer 130 installed therebetween. A glass substrate is typically used for both the rear substrate 110 and the front substrate 120.

A structure to achieve field emission is provided on the rear substrate 110 and a structure to form a predetermined image by electrons emitted due to field emission is provided on the front substrate 120.

Figure 5A:
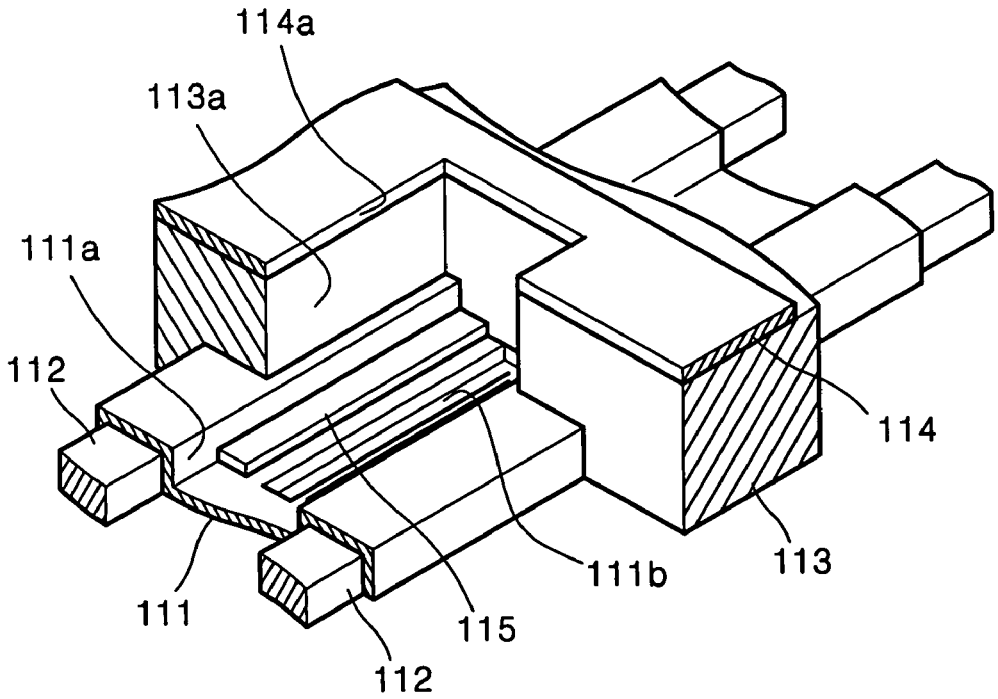
FIGS. 5A through 5C are partial perspective views of three types of a first insulating layer and a cathode of the FED of FIG. 3.
Figure 5B:
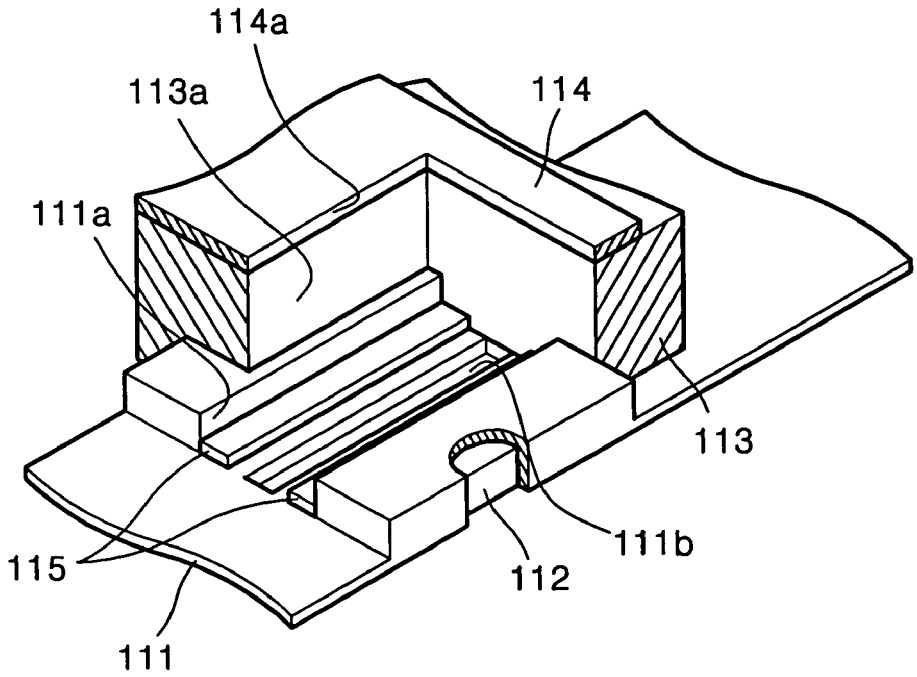
Figure 5C:
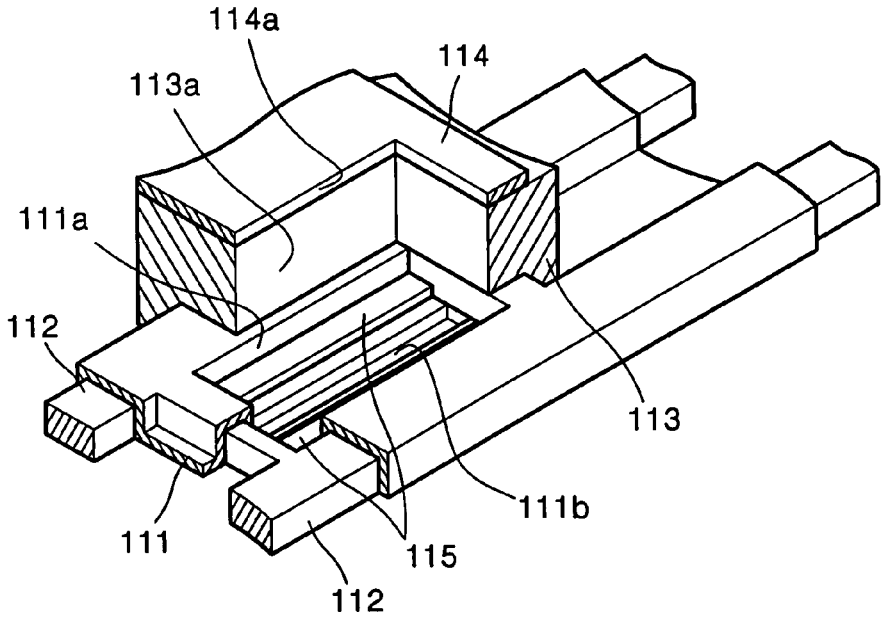

Specifically, a first insulating layer 112 is formed on the rear substrate 110. The first insulating layer 112 is formed as illustrated in FIGS. 5A through 5C and is described in detail below. The first insulating layer 112 can be formed using an insulating paste.

Cathodes 111 arranged, for example, in the form of stripes, are formed on the rear substrate 110. The cathode 111 covers the first insulating layer 112. Thus, a portion of the cathode 111 covering the first insulating layer 112 is higher than the remainder of the cathode 111 by the height of the first insulating layer 112 and a concave first opening 111*a* is formed between portions of the cathode 111 covering the first insulating layer 112. One first opening 111*a* is formed with respect to one pixel 125 and can have a longitudinally long shape corresponding to a shape of the pixel 125, i.e., a rectangular shape longer in a direction of length of the cathode 111 (direction Y).

The cathode 111 can be composed of an electrically conductive metallic material or a transparent electrically conductive material, for example, Indium Tin Oxide (ITO). The material of the cathode 111 varies according to the method of forming an emitter 115 as described below.

Since the cathode 111 completely covers the first insulating layer 112, when forming a second opening 113*a* in a second insulating layer 113 as described below, the first insulating layer 112 is not affected by an etchant. This is described again below.

A cavity 111*b* exposing the rear substrate 110 is formed in the cathode 111. The cavity 111*b* is arranged between emitters 115. One cavity 111*b* can be formed with respect to one pixel 125 and can have a longitudinally long shape corresponding to the shape of the pixel 125, i.e., a rectangular shape longer in a direction of length of the cathode 111 (direction Y). The width ($W_C$) of the cavity 111*b* is less than the width ($W_1$) of the first opening 111*a*.

A second insulating layer 113 is formed on the rear substrate 110 and the cathode 111. The second insulating layer 113 can be formed to a thickness of about 10-20 using, for example, an insulating paste. A second opening 113*a* connected to the first opening 111*a* is formed in the second insulating layer 113. The second opening 113*a* also has a rectangular shape longer in a direction of a length of the cathode 111 (direction Y) similar to that of the first opening 111*a* and its width ($W_2$) is greater than the width ($W_1$) of the first opening 111*a*. Thus, since the first opening 111*a* is completely exposed through the second opening 113*a*, a portion of cathode 111 located in the first opening 111*a* is also completely exposed.

A plurality of gate electrodes 114, separated by a predetermined distance in a predetermined pattern, for example, in the form of stripes, are formed on the second insulating layer 113. The gate electrode 114 extends in a vertical direction (direction X) of longitudinal direction of cathode 111 (direction Y). The gate electrode 114 can be composed of an electrically conductive metal, for example, chromium (Cr) and can have a thickness of thousands of Ås. A third opening 114*a* connected to the second opening 113*a* is formed in the gate electrode 114. The third opening 114*a* can have the same shape as the second opening 113*a* and its width ($W_3$) can also be equal to the width ($W_2$) of the second opening 113*a*.

The emitter 115 is formed on the cathode 111 located in the first opening 111*a*. The emitter 115 has a thickness smaller than that of the first insulating layer 112 and is flat. The emitter 115 emits electrons by an electric field formed by a voltage supplied between the cathode 111 and the gate electrode 114. In the present invention, carbon based materials, for example, graphite, diamond, Diamond like Carbon (DLC), $C_{60}$ (Fullerene), Carbon Nano-Tubes (CNTs), and the like are used for the emitter 115. In particular, CNTs capable of smoothly causing electron emission even at a relatively low driving voltage can be used for the emitter 115.

In the present embodiment, the emitters 115 are arranged along both edges of the first opening 111*a* and spaced apart by a predetermined distance. In other words, two emitters 115 are arranged in one first opening 111*a* and are in contact with side surfaces of the cathode 111 of both sides of the first opening 111*a* and have rod shapes extending parallel to each other in a direction of length of the first opening 111*a* (direction Y). Thus, since the emitters 115 can have a broader area than a conventional emitter, the reliability during their lifetime can be ensured even in the case of long driving periods. When the cavity 111*b* is arranged between the emitters 115 as describe above, the distance (D) between the emitters 115 is less than the width ($W_1$) of the first opening 111*a* and is greater than the width (Wc) of the cavity 111*b*.

FIGS. 5A through 5C are views of three types of the first insulating layer 112 and the cathode 111.

Referring to FIG. 5A, the first insulating layer 112 can extend in a direction of length of the cathode 111 along both edges of the cathode 111. In other words, the first insulating layer 112 is formed on both outer sides of the first opening 111*a*. The emitters 115 are in contact with side surfaces of the cathodes 111 located on both sides of the first opening 111*a* and have a predetermined length. Also, the cavity 111*b* formed in the cathode 111 can be arranged between the emitters 115 and can have the same length like the emitters 115.

Referring to FIG. 5B, the first insulating layers 112 can be arranged on both outer sides of the first opening 111*a* and can be formed on both edges of the cathode 111 to a predetermined length. The first insulating layer 112 can have the same length as the emitters 115.

Referring to FIG. 5C, the first insulating layer 112 can completely surround the first opening 111*a*. All four side surfaces of the first opening 111*a* are defined by the cathode 111 covering the first insulating layer 112.

Returning to FIGS. 3 and 4, an anode 121 is formed on a surface of the front substrate 120, i.e. a lower surface facing the rear substrate 110, and a fluorescent layer 122 composed of R, G, and B phosphors is formed on the surface of the anode 121. The anode 121 is composed of a transparent electrically conductive material to transmit visible light rays emitted from the fluorescent layer 122, for example, ITO. The fluorescent layer 122 has a longitudinally long pattern extending in a direction of a length of the cathode 111 (direction Y).

In the lower surface of the front substrate 120, a black matrix 123 can be formed between the fluorescent layers 122 for improving contrast.

Also, a metallic thin film layer 124 can be formed on the surfaces of the fluorescent layer 122 and the black matrix 123. The metallic thin film layer 124 is mainly composed of aluminum and has a thickness of hundreds of Å s to readily transmit electrons emitted from the emitter 115. This metallic thin film layer 124 improves the luminance. When the R, G, and B phosphors of the fluorescent layer 122 are excited by the electron beam emitted from the emitter 115 to emit visible light rays, since the visible light rays are reflected by the metallic thin film layer 124, the amount of visible light rays emitted from the FED increases, thereby improving the luminance.

When the metallic thin film layer 124 is formed on the front substrate 120, the anode 121 cannot be formed thereon. Since the metallic thin film layer 124 is electrically conductive, if a voltage is supplied thereto, the metallic thin film layer 124 can act as the anode 121.

The rear substrate 110 and the front substrate 120 having the above configuration are arranged such that the emitter 115 and the fluorescent layer 122 face each other and are spaced apart by a predetermined distance and are joined by a sealing material (not shown) coated around them. A spacer 130 is installed between the rear substrate 110 and the front substrate 120 in order to maintain a constant distance therebetween.

The operation of the FED according to an embodiment of the present invention having above-described configuration is as follows.

When a predetermined voltage is supplied to each of the cathodes 111, the gate electrode 114, and the anode 121, electrons are emitted from the emitter 115 while an electric field is formed among these electrodes 111, 114, and 121. A negative (−) voltage between 0 and tens of volts is supplied to the cathode 111, a positive (+) voltage between several and tens of volts is supplied to the gate electrode 114, and a positive (+) voltage between hundreds and thousands of volts is supplied to the anode 121. Electrons emitted from the emitter 115 form an electron beam and the electron beam proceeds toward the anode 121 and collides with the fluorescent layer 122. As a result, the R, G, and B phosphors of the fluorescent layer 122 are excited to emit visible light rays.

Since the emitters 115 are arranged along both edges of the first opening 111*a*, the electron beam formed by the electrons emitted from the emitter 115 can be focused without being widely diverged. Also, since the cathodes 111 are higher than the emitters 115 on both outer sides of the emitters 115, focusing of the electron beam is more efficient due to the electric field formed by the cathode 111.

When forming the cavity 111*b* in the cathode 111, equipotential lines of an electric field are formed to surround the emitter 115. Due to the effect of such an electric field, a current density increases, and thus, the luminance of an image increases, thereby lowering the driving voltage. Also, since the electron beam can be more effectively focused by adjusting the width (Wc) of the cavity 111*b*, the peak of the current density can be accurately located in a corresponding pixel.

As described above, in the FED according to an embodiment of the present invention, the focusing of the electron beam emitted from the emitter 115 is improved, a current density increases, and a color purity and a luminance of an image are improved since the peak of the current density is accurately located in a corresponding pixel, thereby attaining a high quality image.

The advantages of the FED according to an embodiment of the present invention as described above are further described below later with reference to simulation results.

Figure 6:
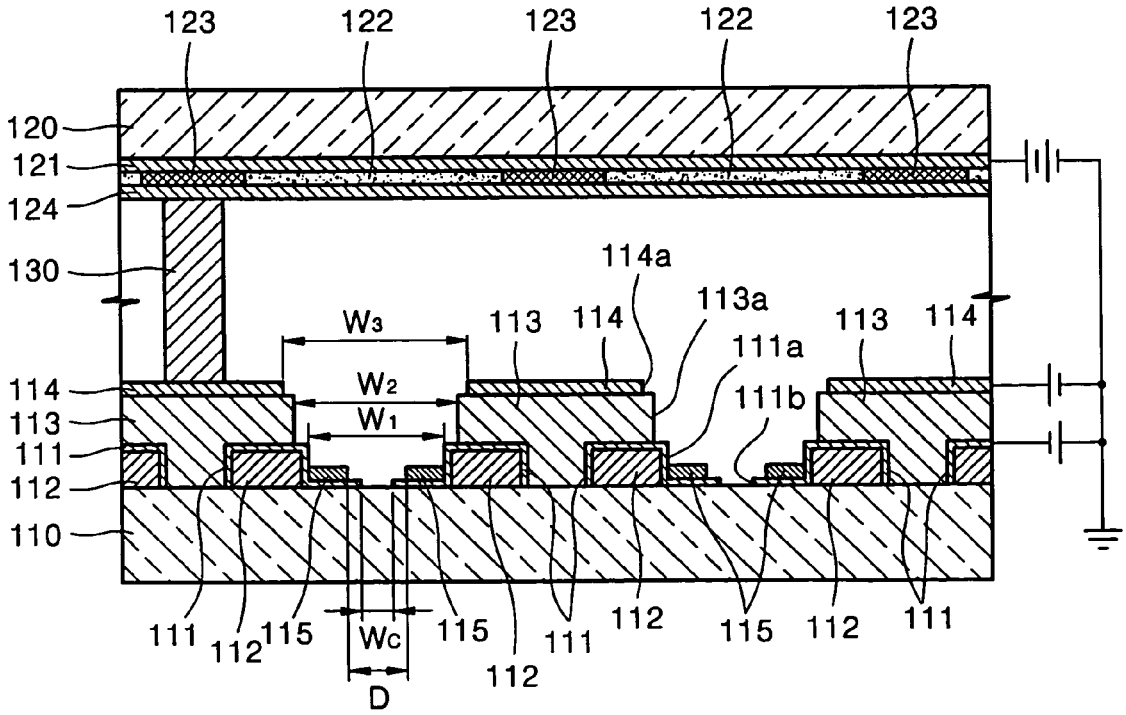
FIG. 6 is a partial cross-sectional view a modification of the FED of FIG. 3.

FIG. 6 is a partial cross-sectional view of a modification of the FED of FIG. 3.

Referring to FIG. 6, the width ($W_3$) of the third opening 114*a* formed in the gate electrode 114 can be greater than the width ($W_2$) of the second opening 113*a* formed in the second insulating layer 113. When the width ($W_3$) of the third opening 114*a* is greater than the width ($W_2$) of the second opening 113*a*, the distance between the cathode 111 and the gate electrode 114 increases, and thus, a withstand voltage characteristic is improved.

Other embodiments of the present invention are as follows.

Figure 7:
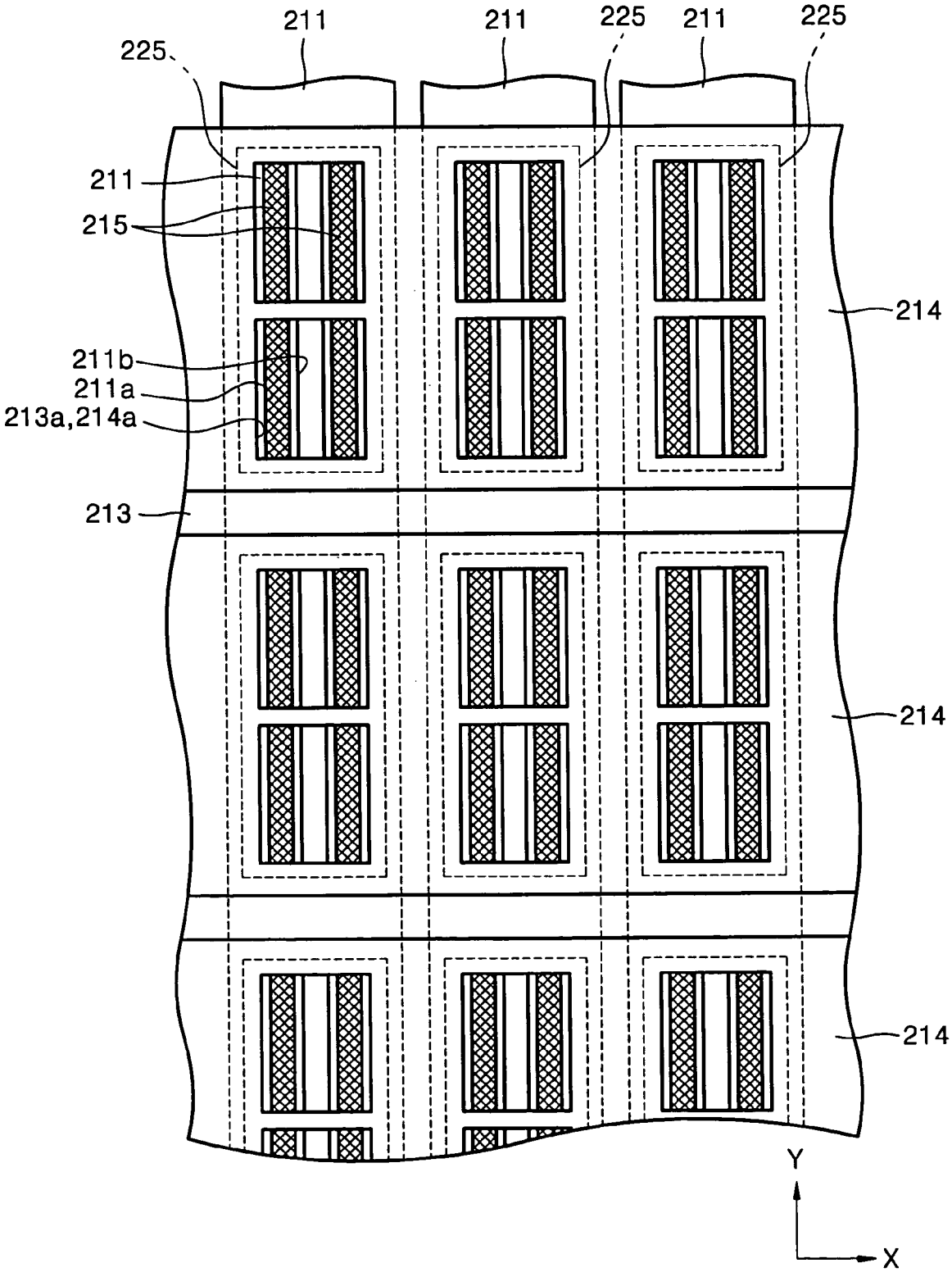
FIG. 7 is a partial plan view of a FED according to another embodiment of the present invention.

FIG. 7 is a partial plan view of the structure of a FED according to another embodiment of the present invention. Since the cross-sectional structure of the FED according to another embodiment of the present invention is identical to that of the FED according to an embodiment of the present invention of FIG. 4, its illustration has been omitted.

Referring to FIG. 7, in this embodiment, there are multiple first openings 211*a*, for example, two first openings 211*a*, formed in a cathode 211, multiple second openings 213*a*, for example, two second openings 213*a*, formed in a second insulating layer 213, and multiple third openings 214*a*, for example, two third openings 214*a*, formed in a gate electrode 214 with respect to one pixel 225. The emitters 215 are formed inside each of multiple first openings 211*a*. The emitters 215 are formed on a cathode 211 located in the first openings 211*a* and arranged along both edges of the first opening 211*a* and spaced apart by a predetermined distance, as described in an embodiment of the present invention.

In the present embodiment, a cavity 211*b* can be also formed in the cathode 211 and there are multiple cavities 211*b*, for example, two cavities 211*b* with respect to one pixel 225.

In the present embodiment, since other structures except for the above-described structures are the same as in the previous embodiment, detailed descriptions thereof have be omitted. Also, the modification illustrated in FIG. 6 can be applied to the present embodiment.

Figure 8:
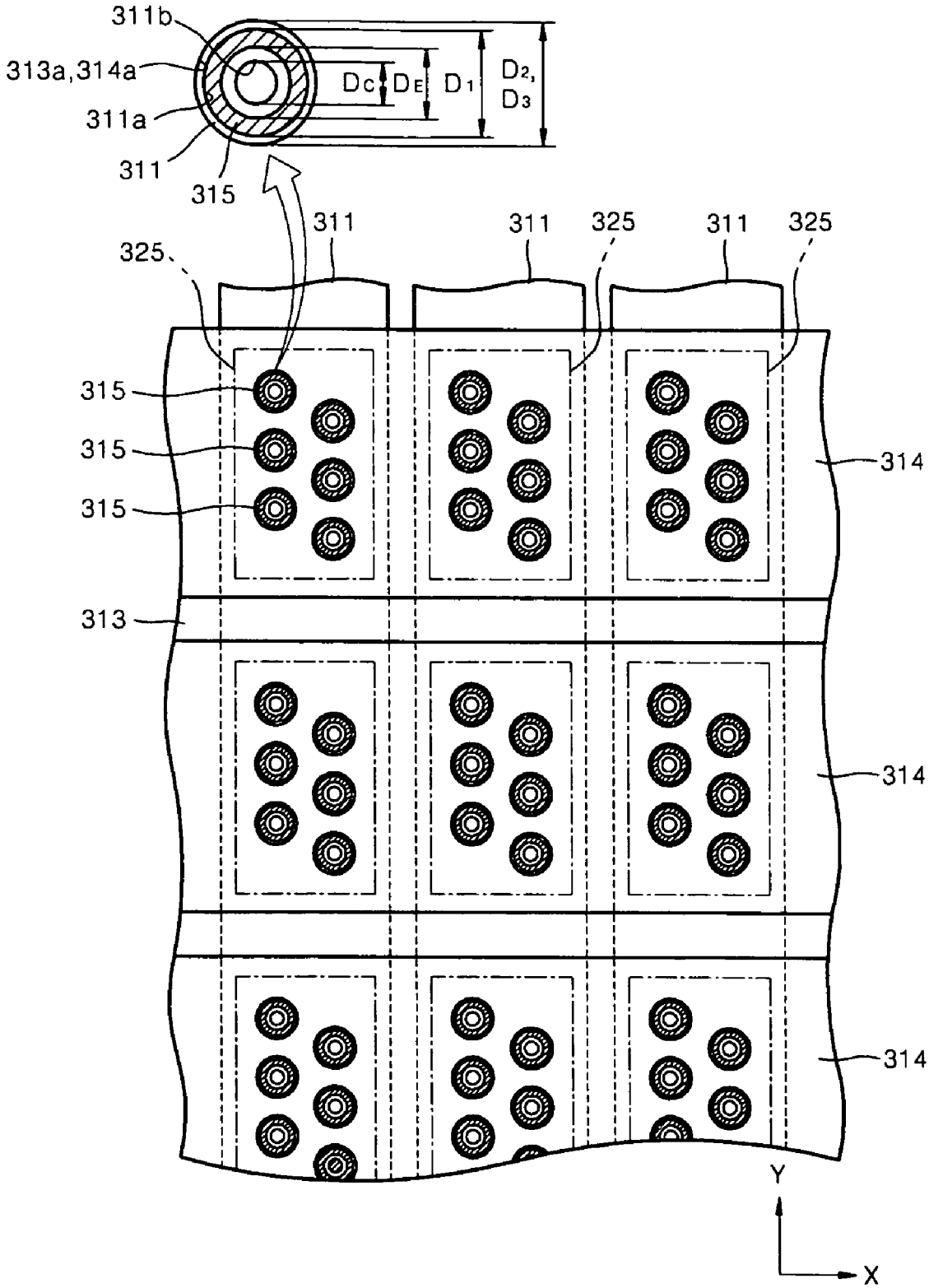
FIG. 8 is a partial plan view of a FED according to still another embodiment of the present invention.

FIG. 8 is a partial plan view of the structure of a FED according to still another embodiment of the present invention. Since the cross-sectional structure of the FED according to still another embodiment of the present invention is also identical to that of the FED according to an embodiment of the present invention of FIG. 4, its illustration has been omitted.

Referring to FIG. 8, a first opening 311*a* formed in a cathode 311, a second opening 313*a* formed in a second insulating layer 313, and a third opening 314*a* formed in a gate electrode 314 have a circular shape. The inner diameter ($D_2$) of the second opening 313*a* is greater than the inner diameter ($D_1$) of the first opening 311*a*. The inner diameter ($D_3$) of the third opening 314*a* can be equal to the inner diameter ($D_2$) of the second opening 313*a*.

A ring shaped emitter 315 is formed on a cathode 311 located in the first opening 311*a*. The emitter 315 is formed such that its circumference is in contact with the side surface of the cathode 311. The inner diameter ($D_3$) of the emitter 315 is less than the inner diameter ($D_1$) of the first opening 311*a*. The emitter 315 can be composed of a carbon based material, for example, Carbon Nano-Tubes.

In the present embodiment, a circular cavity 311*b* can also be formed in the cathode 311 and the cavity 311*b* arranged inside the ring shaped emitter 315. Thus, the inner diameter ($D_C$) of the cavity 311*b* is less than each of the inner diameter ($D_1$) of the first opening 311*a* and the inner diameter ($D_3$) of the emitter 315.

In the FED according to the present embodiment, multiple first openings 311*a*, multiple second openings 313*a*, and multiple third openings 314*a* can be formed with respect to one pixel 325. The ring shaped emitter 315 is formed inside each of multiple first openings 311*a*.

In the present embodiment, since other structures except for the above-described structure are the same as in an embodiment described above, detailed descriptions thereof have been omitted.

The modification illustrated in FIG. 6 can also be applied to the present embodiment. In other words, the inner diameter ($D_3$) of the third opening 314*a* formed in the gate electrode 314 can be greater than the inner diameter ($D_2$) of the second opening 313*a* formed in the second insulating layer 313.

A method of manufacturing a FED according to an embodiment of the present invention having the construction as described above is described below. Although the method described below is based on the FED of FIG. 3, the method can also be applied to the FEDs of FIGS. 6 through 8.

FIGS. 9A through 9I are cross-sectional views of a method of manufacturing the FED according to an embodiment of the present invention.

Figure 9A:
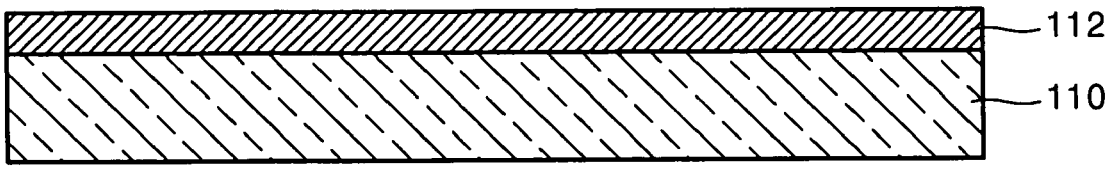
FIGS. 9A through 9I are cross-sectional views of a method of manufacturing a FED according to an embodiment of the present invention.

Referring to FIG. 9A, a substrate 110 is prepared, and then a first insulating layer 112 is formed on the substrate 110. A transparent substrate, for example, a glass substrate, is used as the substrate 110 for back exposure as described below. The first insulating layer 112 can be formed by coating an insulating paste on the substrate 110 by screen printing and then sintering it at a predetermined temperature. In addition to this, the first insulating layer 112 can be formed by various other methods.

Figure 9B:
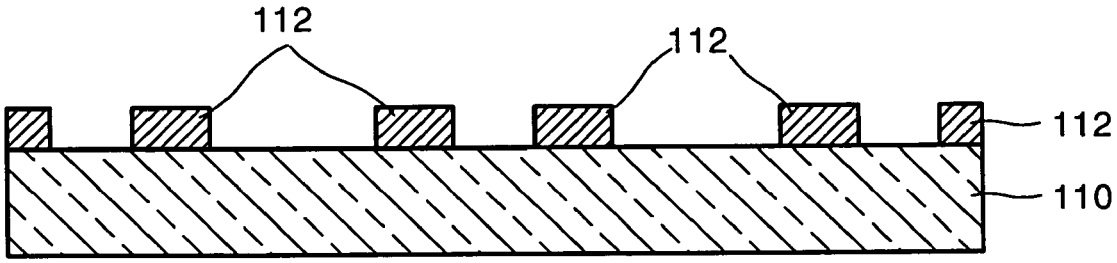

As illustrated in FIG. 9B, the first insulating layer 112 is then patterned in a predetermined form, for example, in the form of one of the forms of FIGS. 5A through 5C. The patterning of the first insulating layer 112 can be performed by a well-known method of patterning a material layer, for example, by forming an etching mask through coating, exposing, and developing a photoresist and then by etching the first insulating layer 112 using the etching mask.

Figure 9C:
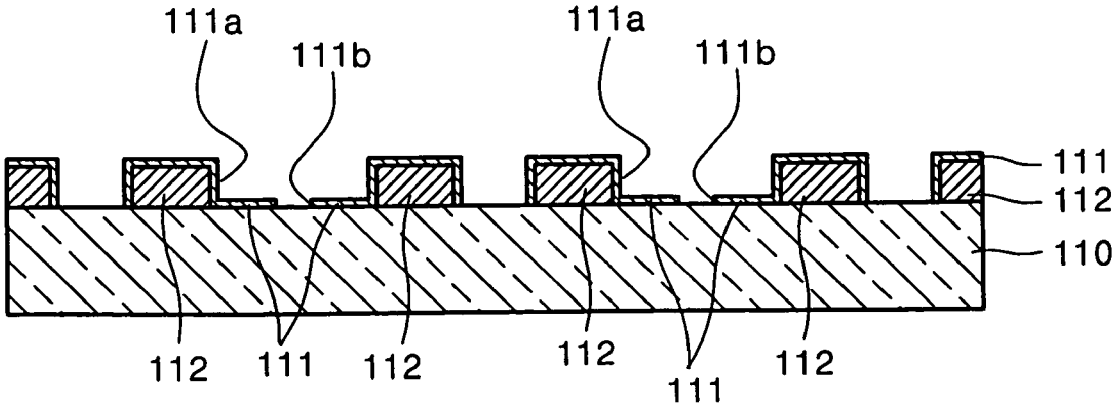

As illustrated in FIG. 9C, a cathode 111 is then formed on the substrate 110 having the first insulating layer 112. The cathode 111 is also composed of a transparent electrically conductive material, for example, ITO for back exposure. Specifically, the cathode 111 can be formed by depositing ITO on the surfaces of the substrate 110 and the first insulating layer 112 to a predetermined thickness, for example, hundreds through thousands of Ås and then patterning it in the form of a stripe. The patterning of ITO can also be performed by a method of patterning a material layer as described above to form the cathode 111 of FIGS. 5A through 5C. Specifically, the cathode 111 covers the upper and side surfaces of the first insulating layer 112. Thus, a first opening 111*a* is formed in the cathode 111 by the first insulating layer 112 having a predetermined height. In other words, a portion of the cathode 111 located on both sides of the first opening 111*a* is higher than the remainder of the cathode 111 by the height of the first insulating layer 112.

During the forming of the cathode 111, a cavity 111*b* of a predetermined shape can be formed in the cathode 111. The cavity 111*b* and the cathode 111 can be simultaneously formed through patterning of ITO as described above. The cavity 111*b* can be smaller than the first opening 111*a* to be located in the first opening 111*a* and can have a rectangular shape longer in a direction of length of the cathode 111 (direction Y) as illustrated in FIG. 4.

When manufacturing the FED of FIG. 8, the first opening and the cavity can be in the form of a circle. The first opening then has a diameter greater than the cavity.

Figure 9D:
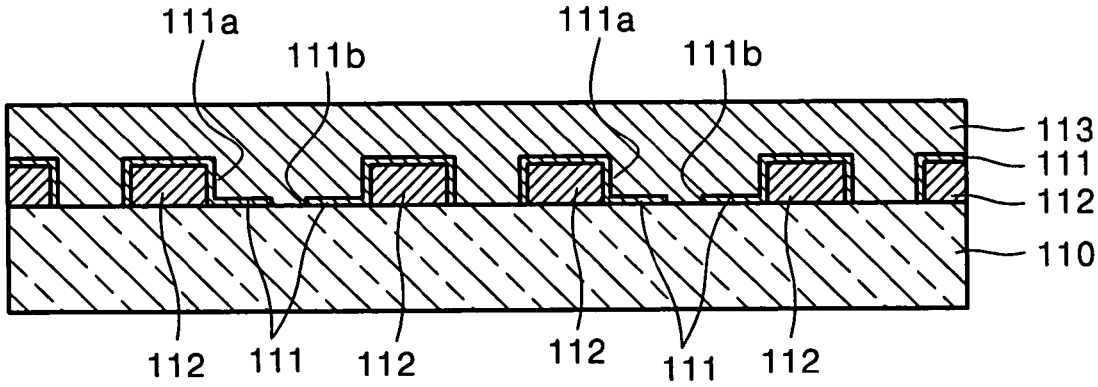

FIG. 9D is a view of a second insulating layer 113 formed on the resultant structure of FIG. 9C.

Referring to FIG. 9D, for example, an insulating paste is coated on the substrate 110 having the first insulating layer 112 and the cathode 111 by screen printing, and then sintered at a predetermined temperature to form the second insulating layer 113.

Figure 9E:
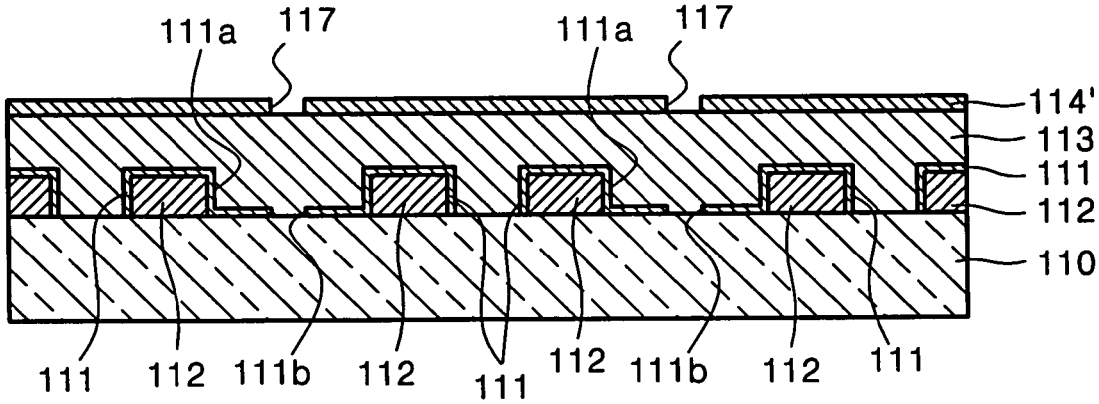

As illustrated in FIG. 9E, a metallic material layer 114' is then formed on the second insulating layer 113. The metallic material layer 114' will form a gate electrode 114 later and can be formed by depositing an electrically conductive metal, for example, chromium (Cr) to a thickness of thousands of Ås via sputtering. Then, holes 117 are formed in the metallic material layer 114'. The holes 117 can be formed by forming an etching mask through coating, exposing to light, and developing a photoresist and then by partially etching the metallic material layer 114' using the etching mask. Each hole 117 is formed in a position corresponding to the first opening 111*a* and has a shape corresponding to that of the first opening 111*a*.

Figure 9F:
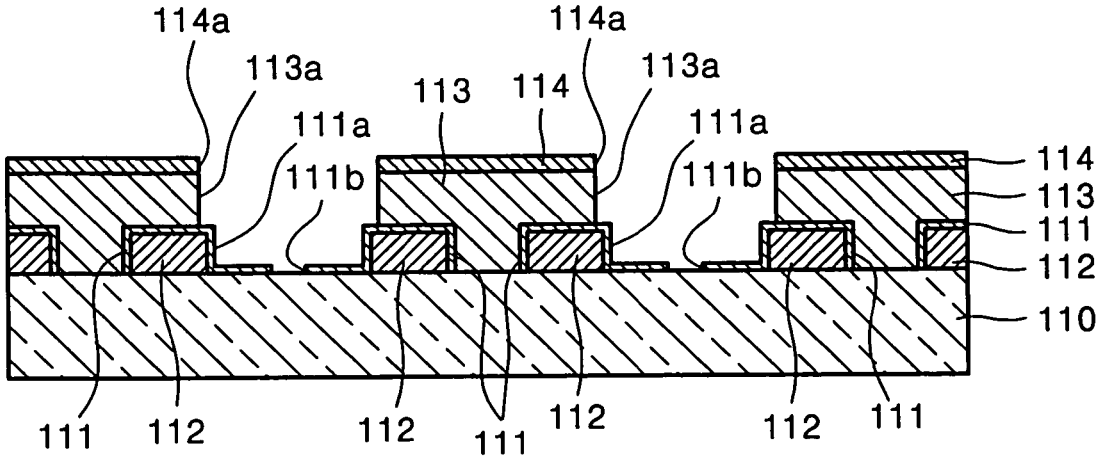

The second insulating layer 113 exposed through the hole 117 is then etched using the metallic material layer 114' as an etching mask until the cathode 111 is exposed. As a result, as illustrated in FIG. 9F, a rectangular second opening 113*a* having a greater width than the first opening 111*a* and exposing a portion of the cathode 111 is formed in the second insulating layer 113. Since the first insulating layer 112 is completely covered by the cathode 111 of ITO, when forming the second opening 113*a* in the second insulating layer 113, the first insulating layer 112 is not damaged by an etchant.

When forming a circular hole in order to manufacture the FED of FIG. 8, the second opening formed in the second insulating layer also has a circular shape.

The metallic material layer 114' is patterned in the form of a stripe to form the gate electrode 114. The patterning of the metallic material layer 114' can be performed using the general method of patterning a material layer as described above. A third opening 114*a* is formed in the gate electrode 114. The third opening 114*a* has the same shape as the second opening 113*a* and is connected to the second opening 113*a*. The width of the third opening 114*a* can be equal to or greater than that of the second opening 113*a*.

Figure 9G:
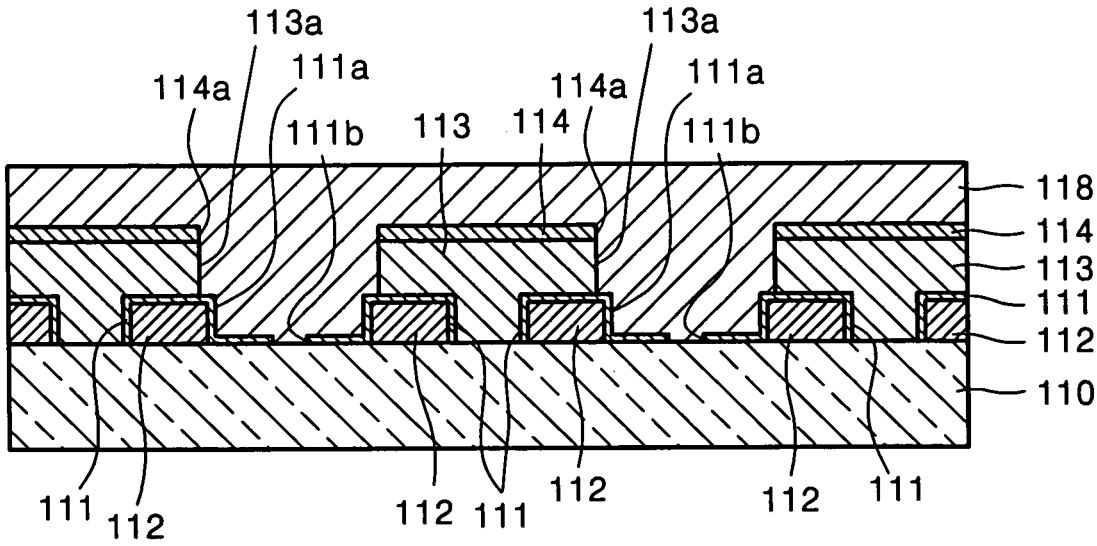
Figure 9H:
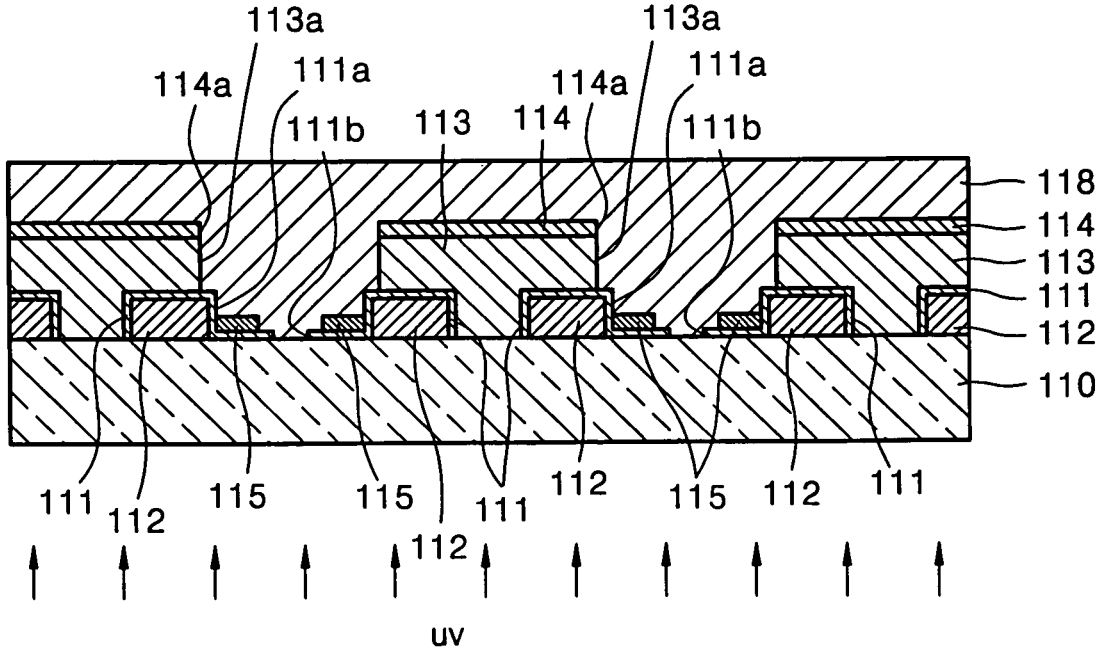
Figure 9I:
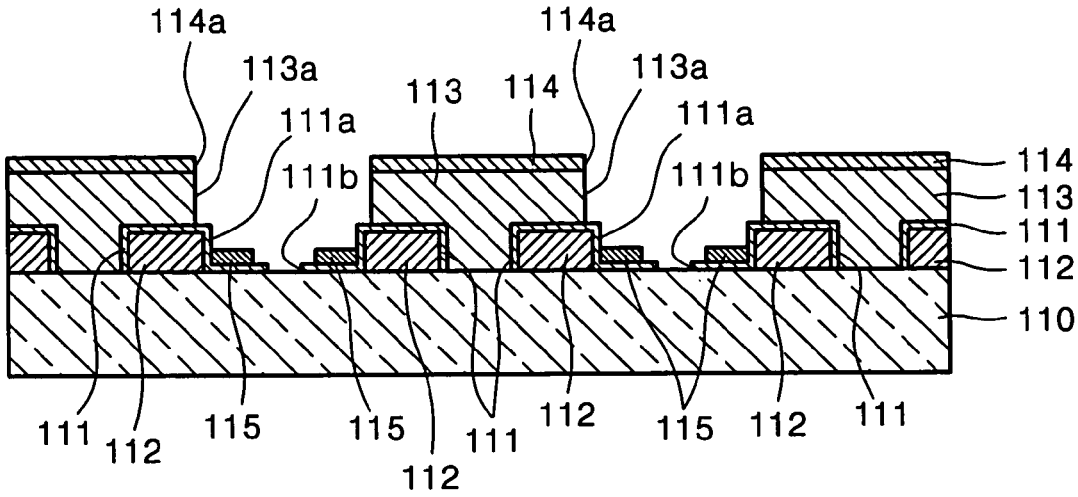

FIGS. 9G through 9I are views of a method forming an emitter 115 on the cathode 111.

As illustrated in FIG. 9G, a CNT photosensitive paste 118 is coated on the entire surface of the resultant structure of FIG. 9F by screen printing. The CNT photosensitive paste 118 must completely fill the first opening 111*a* and the second opening 113*a*.

As illustrated in FIG. 9H, light, for example, Ultra Violet light (UV) is irradiated behind the substrate 110 so as to selectively expose only the CNT photosensitive paste 118 coated on the cathode 111 located in the first opening 111*a*. If the amount of exposure is controlled, the depth of the CNT photosensitive paste 118 exposed can be controlled.

Instead of the back exposure, exposure from the front of the substrate 110 can be performed by using a separate photomask.

If the CNT photosensitive paste 118 which is not exposed to light is removed, then only the exposed CNT paste remains to form the CNT emitter 115 as illustrated in FIG. 9I. Consequently, the emitters 115 are formed on the cathode 111 located in the first opening 111*a* and are arranged along both edges of the first opening 111*a* and are spaced apart by a predetermined distance. The emitter 115 has a height less than the first insulating layer 112 located on both sides of the first opening 111*a* and is flat.

When the second opening is in the form of a circle as illustrated in FIG. 8, a ring-shaped emitter is formed.

FIGS. 10A through 10E are cross-sectional views of another method of manufacturing the FED according to an embodiment of the present invention.

The method described below is substantially identical to that described above except for forming an emitter. However, since this method does not use the back exposure, it is not necessary for the substrate 110 and the cathode 111 to be transparent. In other words, in this method, other substrates having good processibility, for example, a silicone substrate or a plastic substrate as well as a glass substrate can be used as the substrate 110 and an opaque electrically conductive metallic material as well as ITO can be used as the cathode 111.

Figure 10A:
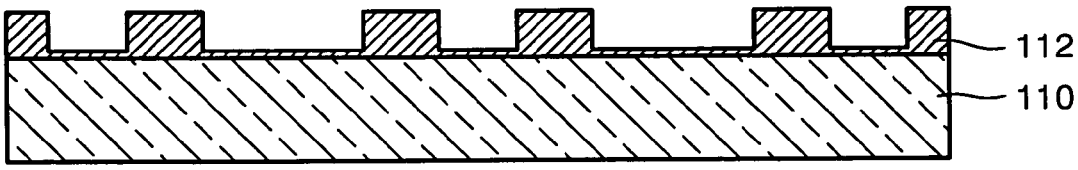
FIGS. 10A through 10E are cross-sectional views of another method of manufacturing a FED according to an embodiment of the present invention.

As illustrated in FIG. 10A, a first insulating layer 112 is formed on a substrate 110, and then patterned in a predetermined form. The first insulating layer 112 can be formed so as to have greater height than in the method described above. When patterning the first insulating layer 112, the substrate 110 is not exposed. In other words, the first insulating layer 112 can remain on the entire surface of the substrate 110 and the thicker portion of the first insulating layer 112 is higher than the thinner portion of the first insulating layer 112.

Figure 10B:
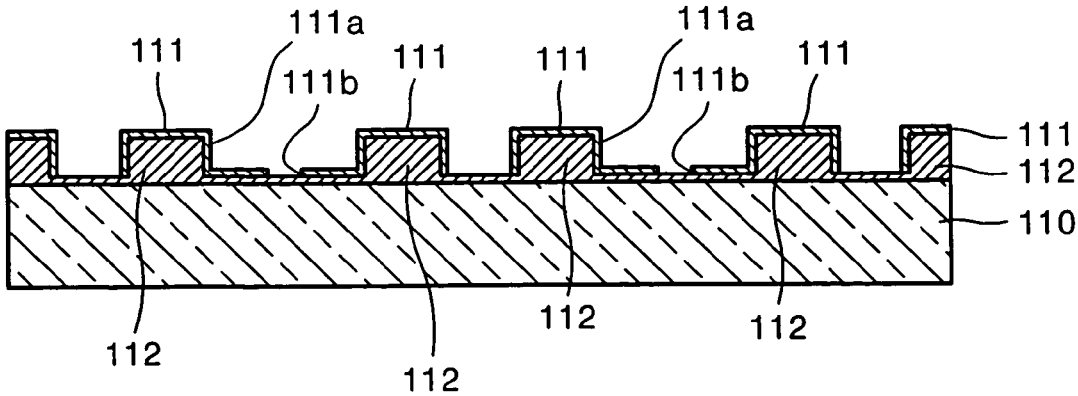

AS illustrated in FIG. 10B, a cathode 111 is then formed on the substrate 110 having the first insulating layer 112. The cathode 111 can be composed of an opaque electrically conductive metal as well as a transparent electrically conductive material ITO as described above. The cathode 111 can also be formed in the same manner as in the above-described method.

Figure 10C:
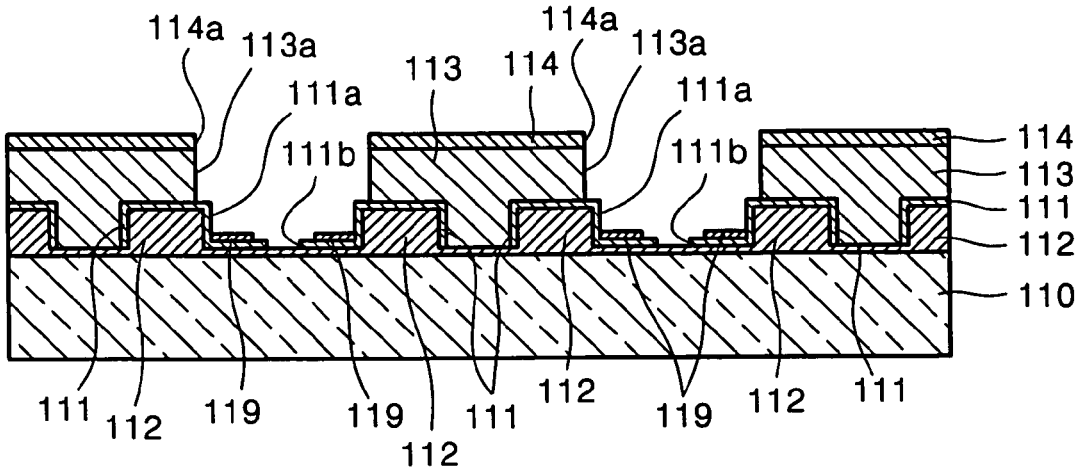

After performing operations of FIGS. 9D through 9F, a photoresist 119 is coated on a surface of the cathode 111 exposed through the second opening 113*a* as illustrated in FIG. 10C. Specifically, the photoresist 119 is coated in the first opening 111*a* and the second opening 113*a*, and then, patterned so as to remain on only the surface of the cathode 111 on which the emitter 115 will be located.

Figure 10D:
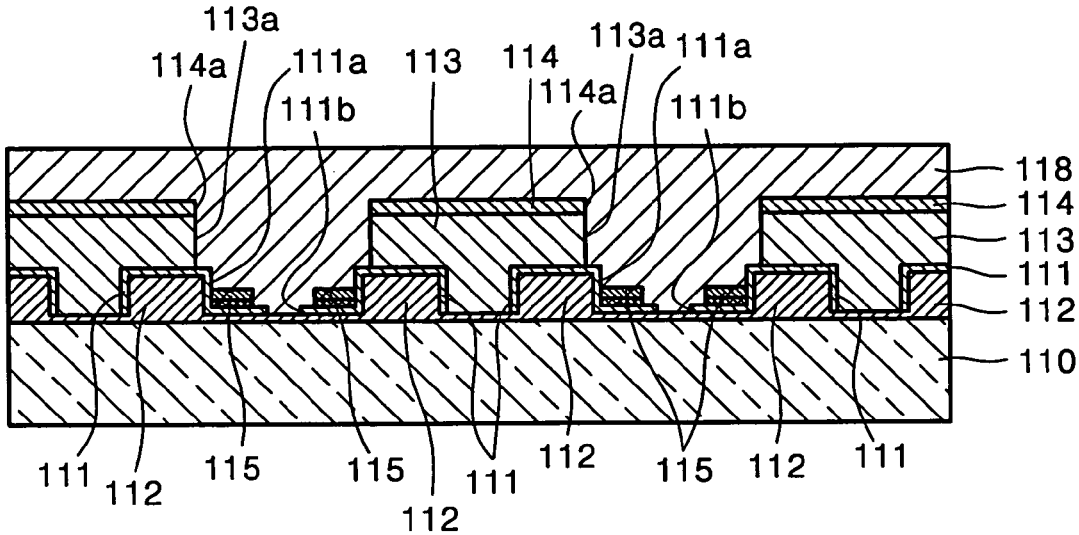

As illustrated in FIG. 10D, a CNT paste 118 is then coated on the entire surface of the resultant structure of FIG. 10C by screen printing. The CNT paste 118 must completely fill the first opening 111*a* and the second opening 113*a*. The substrate 110 is then heated to a predetermined temperature. Thus, the photoresist 119 and the CNT paste 118 undergo a thermochemical reaction to form a CNT emitter 115.

Figure 10E:
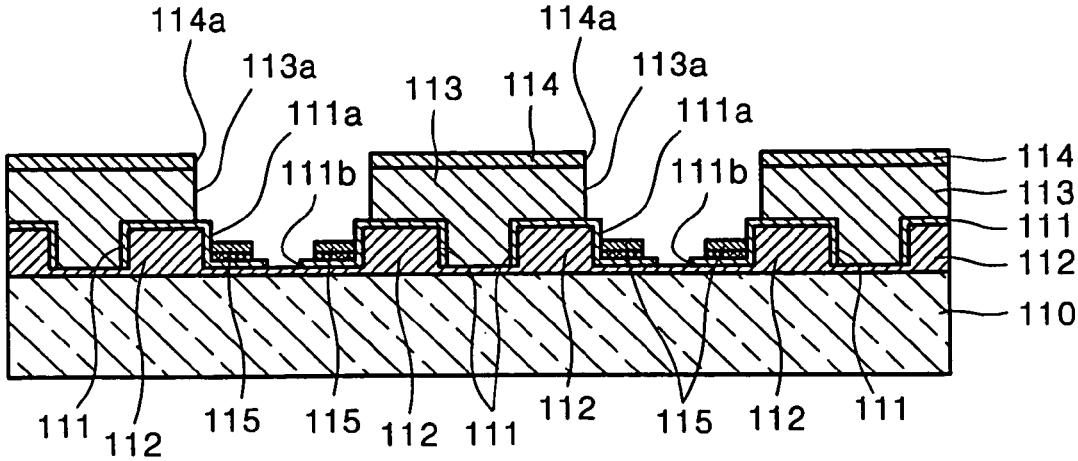

If the CNT paste 118 that does not undergo the thermochemical reaction is then removed, the CNT emitter 115 having a predetermined height is formed on the surface of the cathode 111 as illustrated in FIG. 10E.

The CNT emitter 115 can be formed in another manner. In other words, in the step of FIG. 10C, instead of the photoresist 119, a catalytic metal layer composed of Ni or Fe is formed on the surface of a portion of the cathode 111 on which the emitter 115 will be located, and then, a carbon containing gas such as $CH_4$, $C_2H_2$ or $CO_2$ is supplied to the catalytic metal layer to vertically grow the CNT from the surface of the catalytic metal layer, thereby forming the emitter 115.

Hereinafter, simulation results for an electron beam emission of the FED of FIG. 1 and the FED according to an embodiment of the present invention are described.

In the present simulation, the FED having the structure illustrated in FIG. 1 was used for comparison. Since FEDs according to three embodiments of the present invention have substantially identical cross-sectional structure, thereby their electron beam emission properties are substantially similar. Thus, the simulation for electron beam emission was performed on the FED according to an embodiment of the present invention illustrated in FIG. 3.

Before performing the simulation, design parameters of the elements of the FED required for the simulation were set. For example, when a screen of the FED has an aspect ratio of 16:9 and its diagonal line is 38 inches, if horizontal resolution is designed as 1280 lines in order to obtain the image quality of HD grade, R, G, B trio-pitch is set to 0.70 mm or less.

The height of the second insulating layer can be set to 10-20 micrometers, the height of the first insulating layer can be set to 2-5 micrometers, the width ($W_C$) of the cavity formed in the cathode can be set to 10-30 micrometers, the width ($W_1$) of the first opening formed in the cathode can be set to 70-90 micrometers, the width ($W_2$) of the second opening formed in the second insulating layer can be set to 60-80 micrometers, and the width ($W_3$) of the third opening formed in the gate electrode can be set to 60-90 micrometers.

However, it is apparent that dimensions of elements defined above can vary depending on preconditions such as size, aspect ratio, and resolution of a screen of the FED.

Figure 11A:
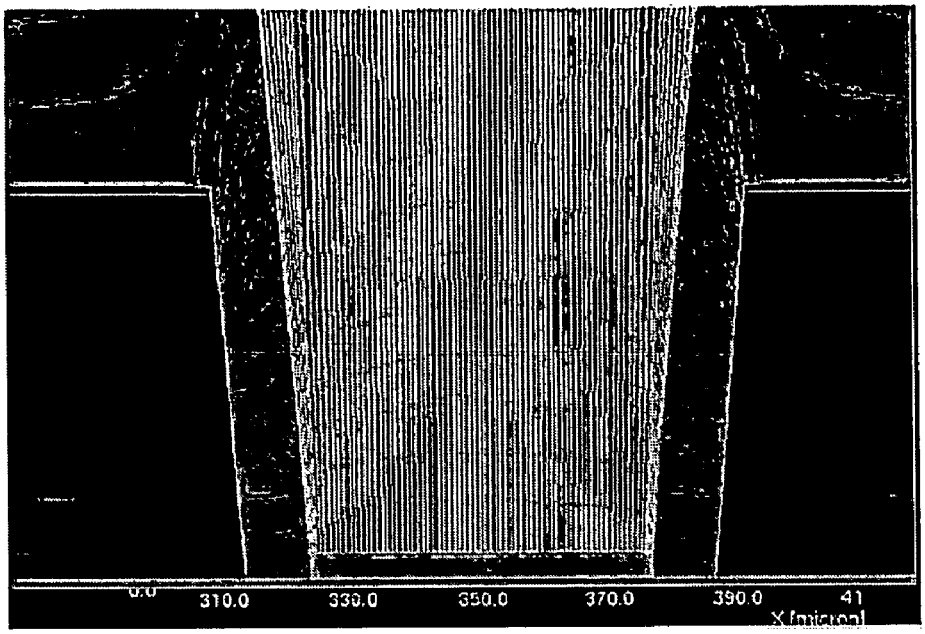
FIGS. 11A through 11C are simulation results for an electron beam emission of the FED of FIG. 1.
Figure 11B:
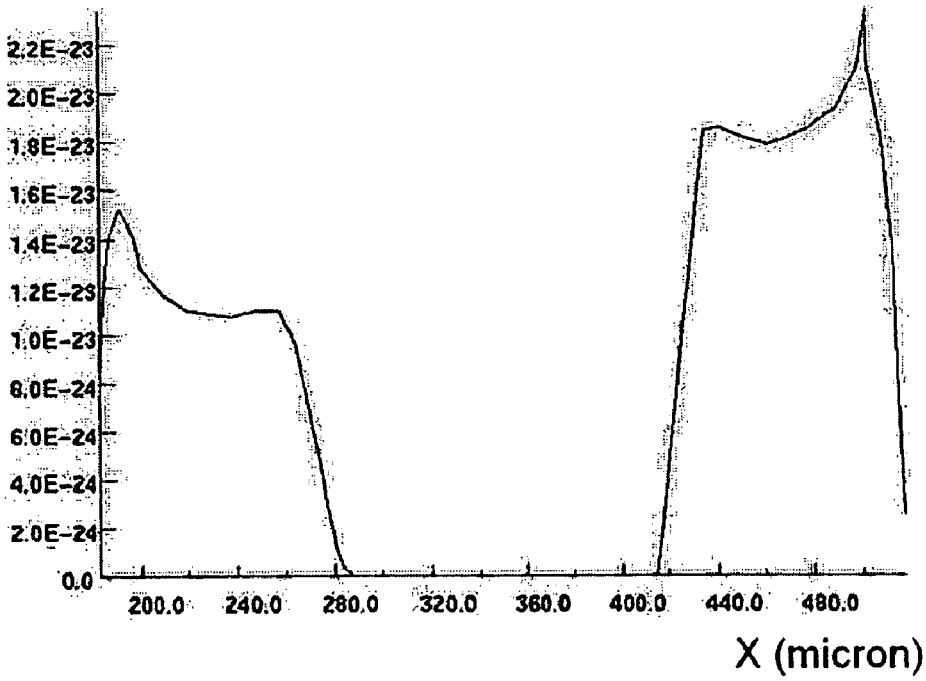
Figure 11C:
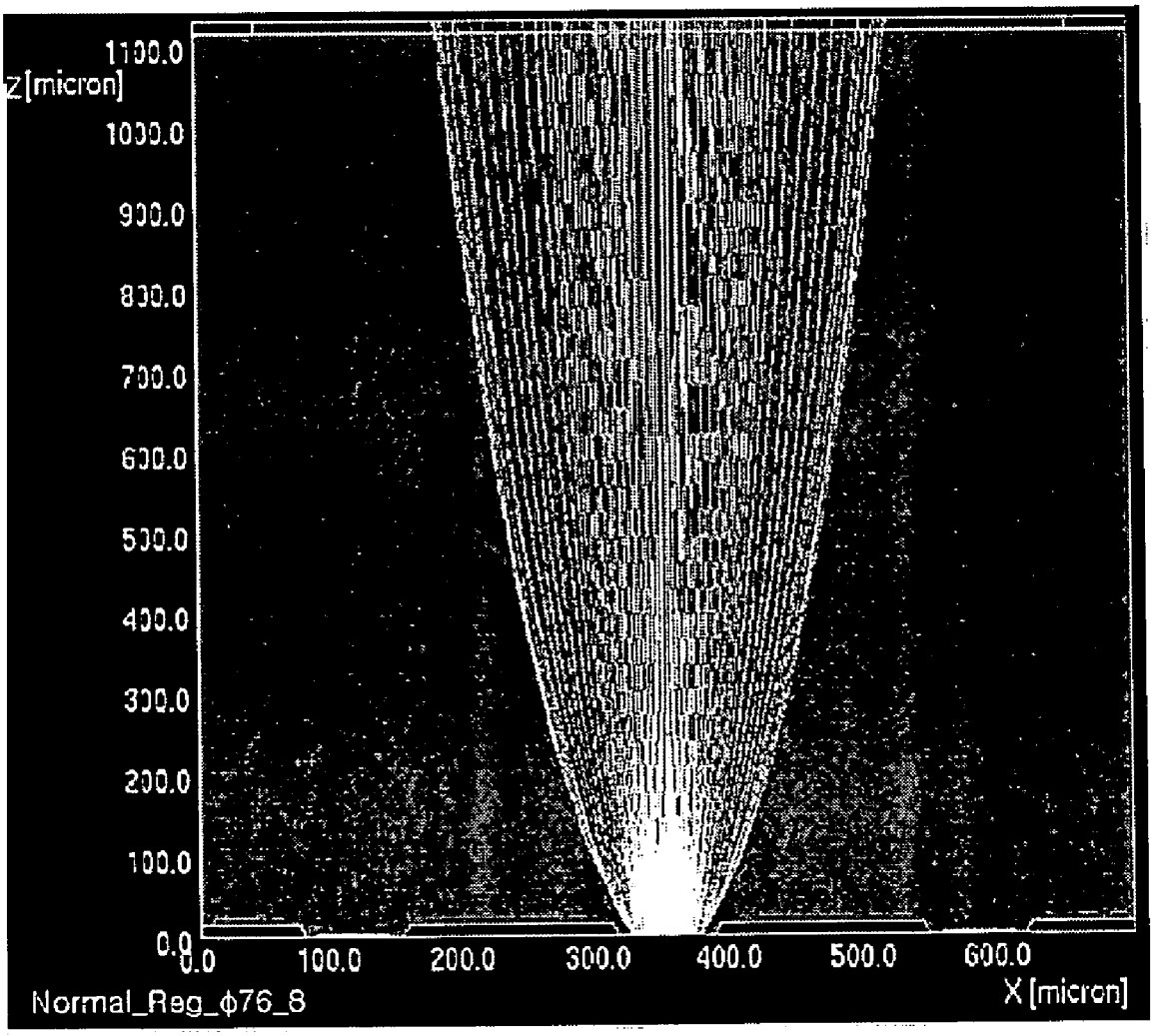

FIGS. 11A through 11C are simulation results for electron beam emission on the FED of FIG. 1.

First, referring to FIG. 11A, the electron beam emitted from an emitter gradually widely diverges while proceeding toward the fluorescent layer.

In FIG. 11B, the longitudinal axis represents current density and peak of current density is located at the edge portion of a pixel. This is because electrons are mainly emitted from the edge portion of the emitter. If a current density at the central portion of a pixel is low, phosphors of the pixel are not sufficiently excited, thereby lowering luminance.

Consequently, as illustrated in FIG. 11C, the size of electron beam spot reached the fluorescent layer is greater than that of the pixel, so that the electron beam invades other adjacent pixels as well as the desired pixel. In particular, when the emitter is not formed in an accurate position in the opening or when an accurate arrangement is not achieved when joining the front substrate and the rear substrate, the peak of current density is highly inclined toward the edge portion of the desired pixel or departs from the desired pixel so as to excite phosphors of other pixels as well, thereby considerably lowering color purity.

As described above, in the FED having the structure of FIG. 1, color purity is lowered and it is difficult to achieving clear image quality.

Figure 12A:
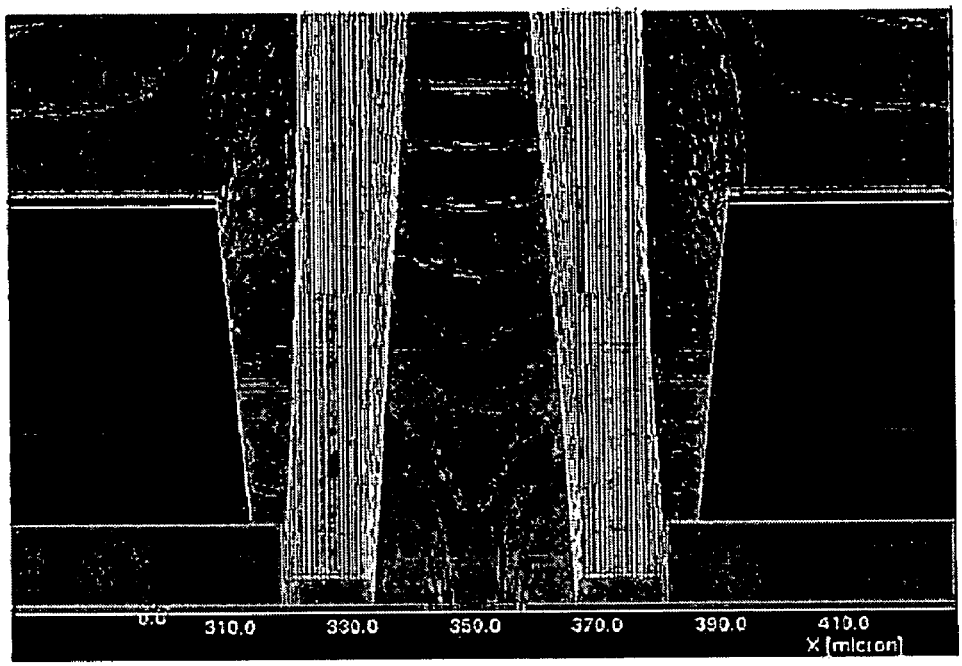
FIGS. 12A through 12C are simulation results for electron beam emission of a FED according to an embodiment of the present invention of FIG. 3.
Figure 12B:
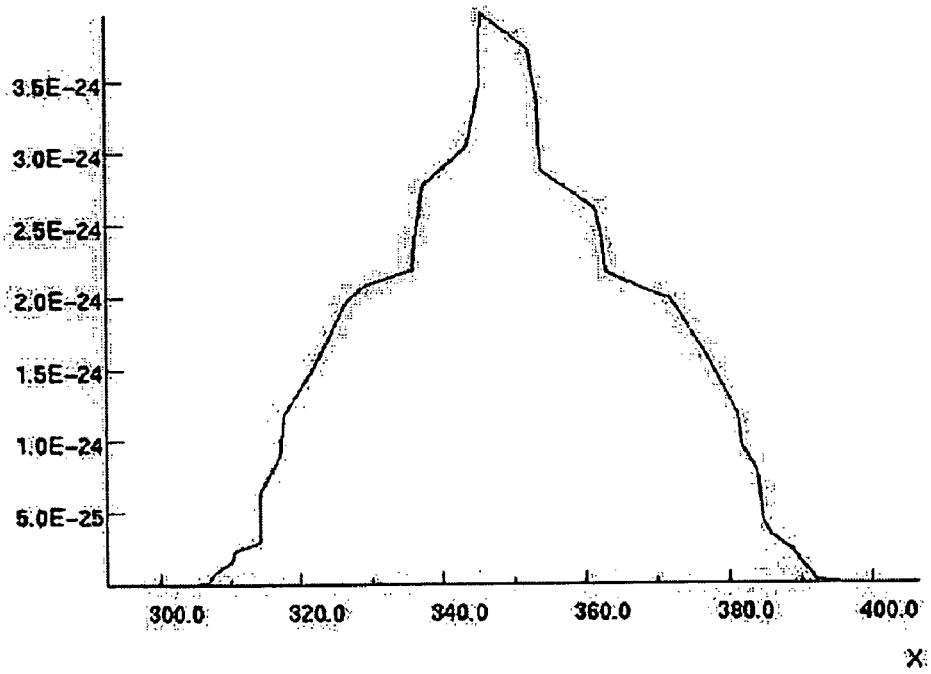
Figure 12C:
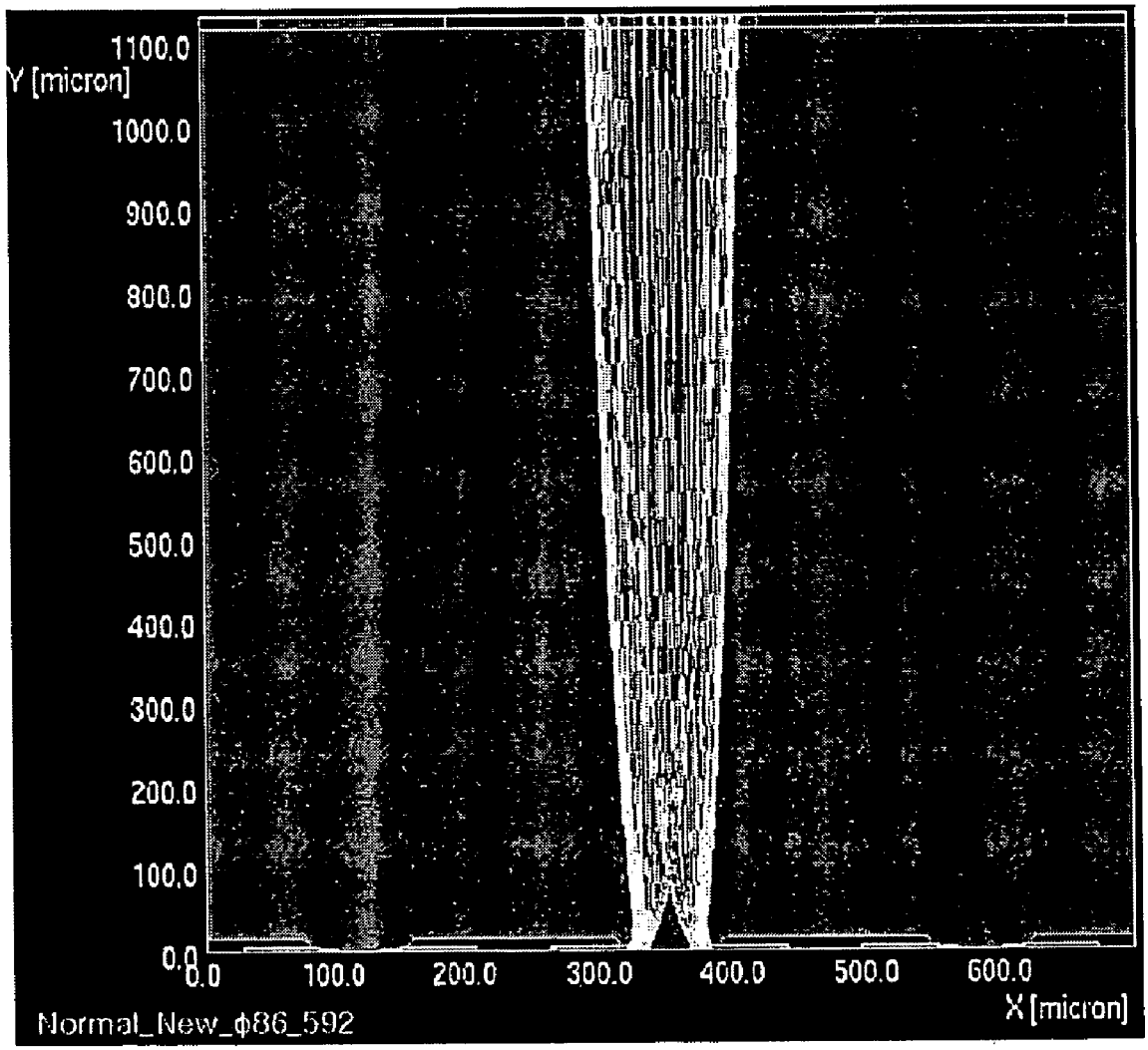

FIGS. 12A through 12C are simulation results for an electron beam emission of the FED according to an embodiment of the present invention of FIG. 3.

Referring to FIG. 12A, an electron beam emitted from the emitters arranged along both edges of the first opening is focused without widely diverging while proceeding toward the fluorescent layer due to the effect of electric field formed by the cathode formed on both sides of the first opening. In particular, equipotential lines of the electric field are formed to surround the emitter due to the cavity formed in the cathode, and thus, the electron beam emitted from the emitter is more effectively focused.

Referring to FIG. 12B, the peak of current density corresponds to a desired pixel and a current density at the central portion of the pixel is very high.

Consequently, as illustrated in FIG. 12C, the size of an electron beam spot on the fluorescent layer considerably decreases compared to the FED of FIG. 1, and thus, the problem that the electron beam invades adjacent pixels is prevented.

As described above, in the FED according to an embodiment of the present invention, the focusing of the electron beam is highly improved, the current density increases, and the peak of current density is accurately located in the desired pixel, thereby improving color purity and luminance.

Figure 13A:
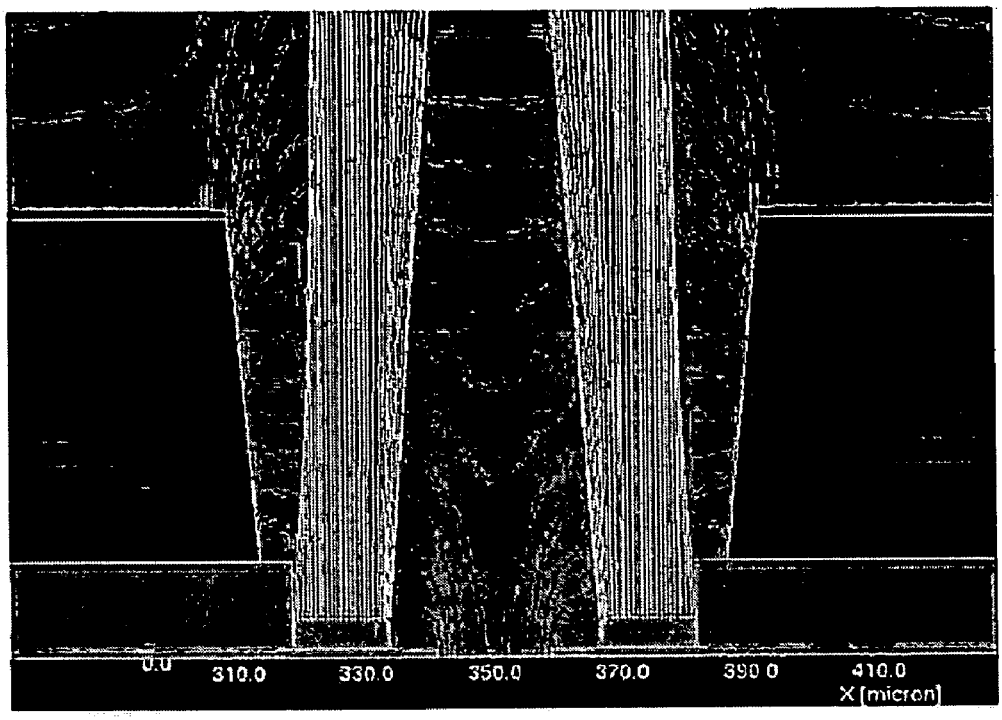
FIGS. 13A through 13C are simulation results for an electron beam emission of a FED according to an embodiment of the present invention of FIG. 3 when the width of a cavity formed in a cathode is changed.
Figure 13B:
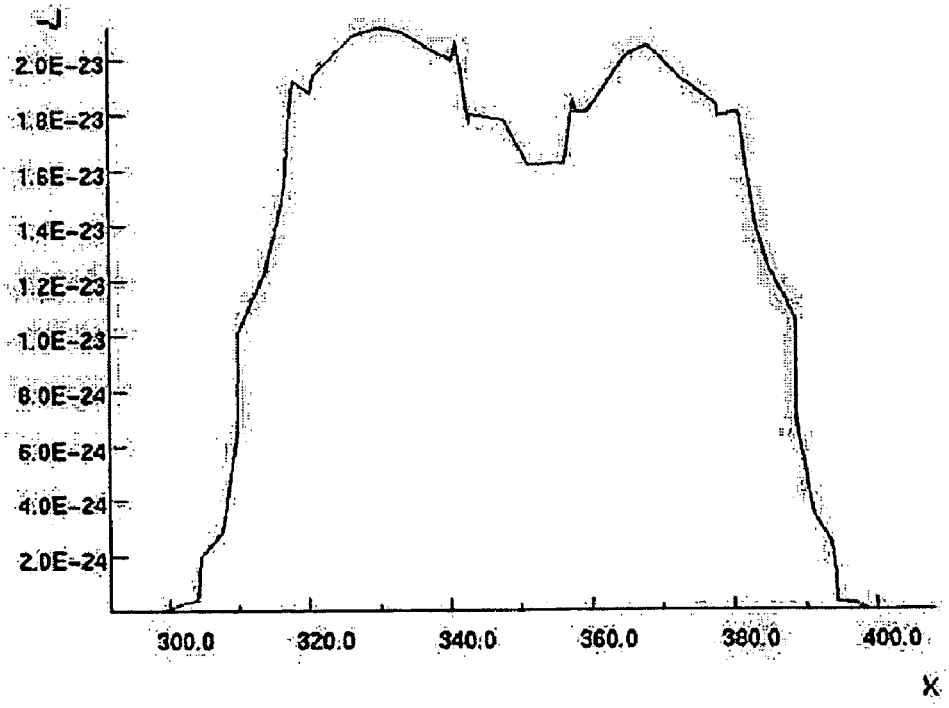
Figure 13C:
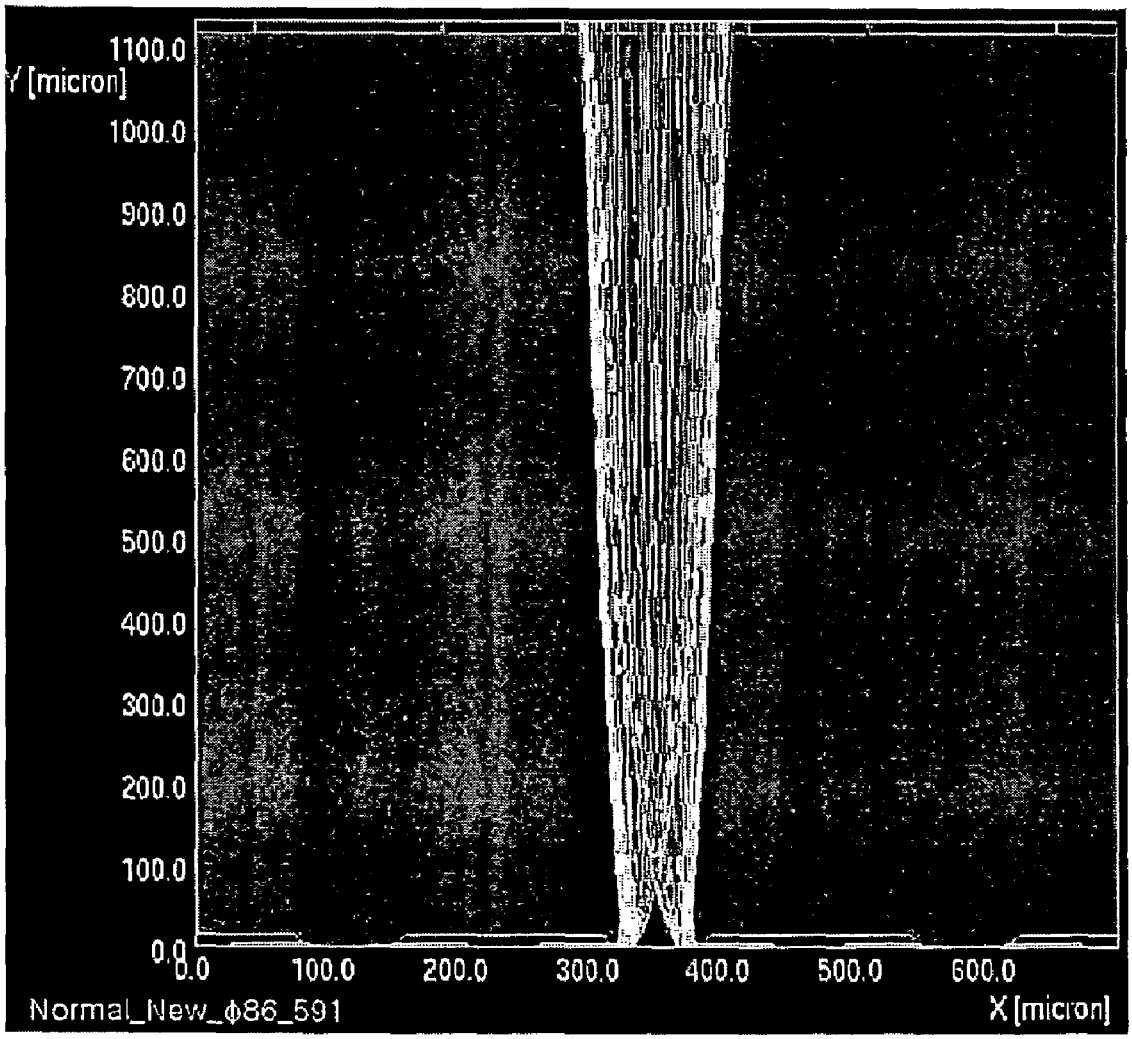

FIGS. 13A through 13C are simulation results for electron beam emission on the FED according to an embodiment of the present invention of FIG. 3 when the width of the cavity formed in the cathode is changed.

The present simulation was performed under the same conditions as in the above-described simulation. However, the width ($W_C$) of the cavity formed in the cathode was increased.

Referring to FIG. 13A, the equipotential lines of electric field are formed to surround the emitter. Referring to FIG. 13B, the density of current flowing toward the desired pixel increases and the peak of current density accurately corresponds to the pixel. Also, referring to FIG. 13C, the size of an electron beam spot on the fluorescent layer is much less than that of the electron beam spot in the FED of FIG. 1.

Consequently, if the width ($W_C$) of the cavity formed in the cathode is controlled, the current density can increase and the luminance of image can be improved and the driving voltage can be lowered.

As described above, in the FED according to an embodiment of the present invention, the focusing characteristic of electron beam emitted from an emitter is improved due to the flat emitter arranged along both edges of an opening and a cathode which is formed on both outer sides of the emitter and is higher than the emitter, and thus, a color purity of image is improved, thereby obtaining a high quality image.

Also, in the FED according to an embodiment of the present invention, the equipotential lines of the electric field are formed to surround an emitter due to a cavity formed in a cathode. Due to the effect of such electric field, a current density increases, so that luminance of image can be improved.

Also, since a first insulating layer is completely covered by a cathode composed of ITO or a metallic material, damage of the first insulating layer due to an etchant when forming an opening in a second insulating layer through etching process can be prevented.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A Field Emission Display (FED) comprising:

a first substrate;

a first insulating layer arranged on the first substrate;

a cathode arranged on the first substrate to cover the first insulating layer, the cathode having a first opening arranged between portions thereof covering the first insulating layer;

a second insulating layer arranged on the first substrate and the cathode, the second insulating layer having a second opening connected to the first opening to expose a portion of the cathode;

a gate electrode arranged on the second insulating layer, the gate electrode having a third opening connected to the second opening;

a plurality of emitters arranged on the cathode in the first opening and along both edges of the first opening and spaced apart from each other; and a second substrate facing the first substrate and spaced apart therefrom and having an anode and a fluorescent layer arranged on a surface thereof:

wherein the cathode comprises a cavity arranged between the plurality of emitters; and wherein a distance between the plurality of emitters is less than a width of the first opening and is greater than a width of the cavity.

2. The FED of claim 1, wherein the first, second, and third openings and the cavity are rectangular.

3. The FED of claim 2, wherein the width of the second opening is greater than that of the first opening and the width of the cavity is less than that of the first opening.

4. The FED of claim 3, wherein the width of the third opening is equal to that of the second opening.

5. The FED of claim 3, wherein the width of the third opening is greater than that of the second opening.

6. The FED of claim 1, wherein the first insulating layer is arranged on both outer sides of the first opening and extends in a direction of a length of the cathode along both edges of the cathode.

7. The FED of claim 1, wherein the first insulating layer is arranged on both outer sides of the first opening and a portion of the first insulating layer is arranged on both edges of the cathode.

8. The FED of claim 1, wherein the first insulating layer surrounds the first opening.

9. The FED of claim 1, wherein a portion of the plurality of emitters contacts a side surface of the cathode arranged on both sides of the first opening.

10. The FED of claim 1, wherein a height of a portion of the plurality of emitters is less than that of the first insulating layer.

11. The FED of claim 1, wherein the plurality of emitters comprises a carbon based material.

12. The FED of claim 11, wherein the plurality of emitters comprises Carbon Nano-Tubes (CNTs).

13. The FED of claim 1, wherein a plurality of first openings, second openings, and third openings are arranged with respect to one pixel and wherein a portion of the plurality of emitters is arranged in each first opening.

14. A Field Emission Display (FED) comprising:

a first substrate;

a first insulating layer arranged on the first substrate;

a cathode arranged on the first substrate to cover the first insulating layer, the cathode having a first circular opening arranged inside a portion thereof covering the first insulating layer;

a second insulating layer arranged on the first substrate and the cathode, the second insulating layer having a second circular opening connected to the first circular opening to expose a portion of the cathode;

a gate electrode arranged on the second insulating layer, the gate electrode having a third circular opening connected to the second circular opening;

a ring shaped emitter arranged on the cathode arranged in the first opening; and a second substrate facing the first substrate and spaced apart therefrom, the second substrate having an anode and a fluorescent layer arranged on a surface thereof;

wherein a circular cavity is arranged inside the emitter in the cathode; and wherein an inner diameter of the ring shaped emitter is less than that of the first circular opening and is greater than that of the circular cavity.

15. The FED of claim 14, wherein an inner diameter of the second circular opening is greater than that of the first circular opening and the inner diameter of the circular cavity is less than that of the first circular opening.

16. The FED of claim 15, wherein an inner diameter of the third circular opening is equal to that of the second circular opening.

17. The FED of claim 15, wherein an inner diameter of the third circular opening is greater than that of the second circular opening.

18. The FED of claim 14, wherein the emitter is in contact with a side surface of the cathode surrounding the first circular opening.

19. The FED of claim 14, wherein a height of the emitter is less than the that of the first insulating layer.

20. The FED of claim 14, wherein the emitter comprises a carbon based material.

21. The FED of claim 20, wherein the emitter comprises Carbon Nano-Tubes (CNTs).

22. The FED of claim 14, wherein a plurality of first circular openings, second circular openings, and third circular openings are arranged with respect to one pixel and the emitter is arranged inside each first circular opening.

* * * * *